US009528743B2

(12) United States Patent
Andersson et al.

(10) Patent No.: US 9,528,743 B2
(45) Date of Patent: Dec. 27, 2016

(54) COLD APPLIANCE

(75) Inventors: Bernt Andersson, Stockholm (SE); Klas Andersson, Lidingo (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 618 days.

(21) Appl. No.: 12/992,135

(22) PCT Filed: May 19, 2009

(86) PCT No.: PCT/EP2009/003564

§ 371 (c)(1),
(2), (4) Date: Mar. 18, 2011

(87) PCT Pub. No.: WO2009/141117

PCT Pub. Date: Nov. 26, 2009

(65) Prior Publication Data

US 2011/0179817 A1 Jul. 28, 2011

(30) Foreign Application Priority Data

May 23, 2008 (SE) ..... 0801207-2

(51) Int. Cl.
*F25D 23/10* (2006.01)
*F25D 19/00* (2006.01)
(Continued)

(52) U.S. Cl.
CPC ..... *F25D 19/00* (2013.01); *F25D 21/14* (2013.01); *F25D 23/006* (2013.01)

(58) Field of Classification Search
CPC ..... F25D 2321/1412; F25D 2323/00264; F25D 2323/0022; F25D 23/003; F25D 23/006;F25D 21/14; F25D 19/00; F25D 2321/146; F25D 2323/0023; F25D 2317/0651; F25D 23/10; F25D 2323/0021
(Continued)

(56) References Cited

U.S. PATENT DOCUMENTS 1,769,111 A * 7/1930 Davenport ..... F25D 23/003 62/455
2,184,345 A * 12/1939 Hersey ..... 165/165
(Continued)

FOREIGN PATENT DOCUMENTS

GB 2 227 302 A 7/1990
JP 06-058661 A 3/1994
(Continued)

OTHER PUBLICATIONS

International Search Report for PCT/EP2009/003564 dated Jan. 10, 2009.

*Primary Examiner* — Frantz Jules
*Assistant Examiner* — Martha Tadesse
(74) *Attorney, Agent, or Firm* — Pearne & Gordon LLP

(57) ABSTRACT

A cold appliance comprising a cooling module (102) and a cabinet (101) comprising a cold compartment (104). The cooling module comprises an air outlet (43) delivering cooled air to the cold compartment and an air inlet (44) receiving air from the cold compartment. The cooling module is arranged at the bottom of the cold appliance, and comprises a cold section (34), and a warm section (35), which is separated from the cold section by an insulating wall (105). An evaporator (33) is arranged in the cold section, and a compressor (36) and a condenser (32) is arranged in the warm section. The condenser comprises a condenser tube (32), which is arranged in windings on or integrated in a bottom plate (31) of the cooling module.

25 Claims, 20 Drawing Sheets

(51) Int. Cl.
*F25D 21/14* (2006.01)
*F25D 23/00* (2006.01)

(58) Field of Classification Search
USPC ..... 62/279, 288, 454, 264, 246, 285, 255,62/259.1
See application file for complete search history.

(56) References Cited

U.S. PATENT DOCUMENTS 2,226,444 A * 12/1940 Caulk, Jr. ..... F25D 23/003 62/455
3,079,770 A * 3/1963 Brown ..... F25D 23/003 62/455
3,393,530 A * 7/1968 Koch ..... F25D 17/065 62/275
4,156,352 A * 5/1979 Gelbard ..... F25D 21/14 62/285
4,490,990 A * 1/1985 Chastine ..... F25D 21/14 62/279
4,490,991 A * 1/1985 Griffin ..... F25D 21/14 62/279
4,497,183 A * 2/1985 Gelbard ..... F25B 31/006 62/279
4,555,915 A * 12/1985 Dasher ..... F25D 19/00 62/428
4,843,835 A * 7/1989 Goetz ..... F25D 21/14 62/285
5,070,708 A * 12/1991 Malosh ..... F25D 23/006 62/295
5,117,523 A 6/1992 Jacobus et al.
5,253,702 A * 10/1993 Davidson et al. ..... 165/80.4
5,255,536 A * 10/1993 Jung ..... F25D 21/08 62/275
5,277,035 A 1/1994 Fristoe et al.
5,402,654 A * 4/1995 Rudick et al. ..... 62/448
5,428,973 A * 7/1995 Temmyo ..... F25D 23/003 165/157
5,694,785 A * 12/1997 Balentine ..... F24F 13/22 3/22
5,722,254 A * 3/1998 Roth ..... F25D 23/061 62/451
5,881,567 A * 3/1999 Junge ..... F25D 23/003 62/428
6,070,424 A * 6/2000 Bauman ..... F25D 19/00 62/279
6,363,736 B1 * 4/2002 Kunkel et al. ..... 62/291
6,701,739 B2 * 3/2004 Morse ..... 62/277
7,398,655 B2 * 7/2008 Yun et al. ..... 62/295
7,549,300 B2 * 6/2009 Chun ..... F25D 23/003 62/419
7,878,015 B2 * 2/2011 Lim ..... F25D 23/10 62/259.1
7,987,684 B2 * 8/2011 Jeong ..... F25D 21/14 62/407
8,122,733 B2 * 2/2012 Raab ..... 62/302
2002/0134088 A1 * 9/2002 Rudick ..... F25D 19/02 62/6
2004/0003618 A1 * 1/2004 Kim ..... F25D 23/003 62/259.1
2005/0257554 A1 * 11/2005 Yun ..... F16F 15/067 62/295
2006/0207280 A1 * 9/2006 Avila ..... A47F 3/0408 62/255
2006/0277934 A1 * 12/2006 Cho ..... F25D 17/047 62/285
2007/0214824 A1 * 9/2007 Itsuki ..... 62/279
2008/0307815 A1 * 12/2008 Daddis, Jr. et al. ..... 62/246
2009/0320513 A1 * 12/2009 Yamaoka ..... F25C 1/00 62/340
2011/0067431 A1 * 3/2011 Rothmund ..... F25D 23/006 62/455
2011/0113817 A1 * 5/2011 Kofele ..... F25D 21/14 62/455
2013/0255305 A1 * 10/2013 Kim ..... F25D 23/003 62/426

FOREIGN PATENT DOCUMENTS

JP 2002-039664 A 2/2002
JP 2005-283012 A 10/2005
WO 2007/009614 A1 1/2007
WO 2007/070059 A1 6/2007

* cited by examiner

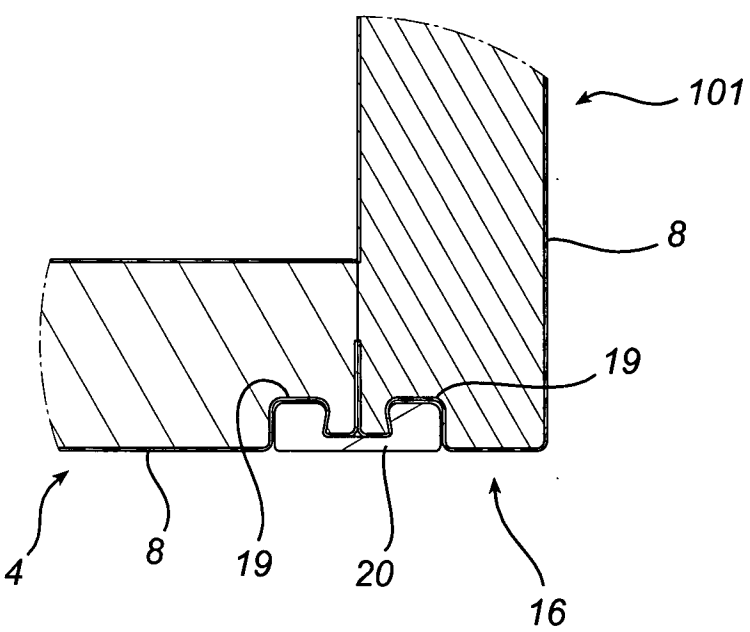
Fig. 4
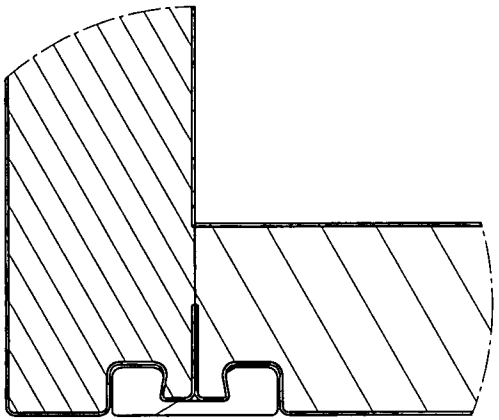

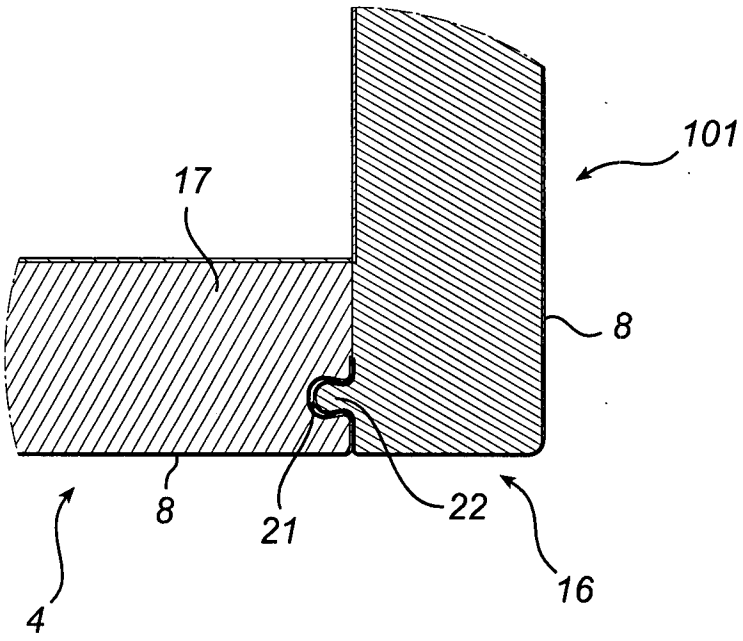
Fig. 5
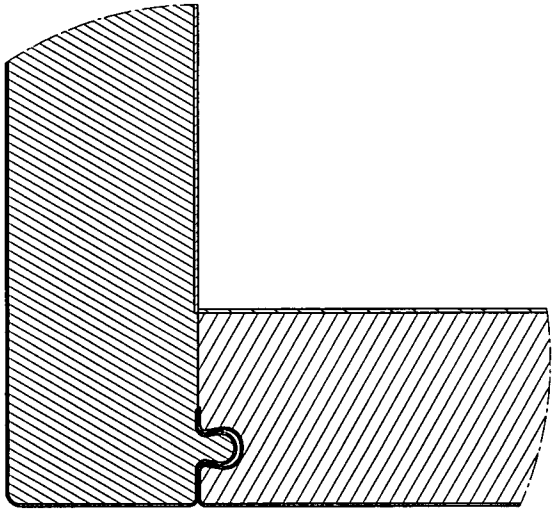

COLD APPLIANCE

FIELD OF THE INVENTION

The invention relates to a cold appliance.

BACKGROUND OF THE INVENTION

When manufacturing household cold appliances, such as refrigerators, comprising also pantries and wine coolers, and freezers, comprising also chest freezers, which are in the form of an openable cabinet and which are primarily adapted for domestic use but also can be used in for example restaurants and laboratories, hereinafter referred to as cold appliances for sake of simplicity, it is common practice to locate the production rather close to the customers, since the costs of transportation are considerable. This results in a comparatively large amount of production sites. It is desirable to rather have a few large production plants, and then distribute the products from these plants to the rest of the world. In this way it is possible to take advantage of large-scale benefits. For example, one problem associated with transporting cold appliances is that they represent bulky products containing a lot of air, which has to effect that the transport costs per weight unit will be considerable. It has been suggested to manufacture cold appliances in a modular fashion, such that the products can be transported in a disassembled state and assembled at the place of installation or at a nearby store, an assembling plant or other service facility. However, no functional modular system has ever been developed for such products. This is due to the various requirements that the cabinet must fulfil. For instance the cabinet must be constructed to be easily assembled to form a rigid and resistant cabinet having good heat insulating properties and being substantially impermeable to moisture migration as well as having an aesthetically attractive appearance. Additionally, a cooling cabinet contains a lot of technical equipment for performing different functions. This equipment, when having the present structure, is difficult to provide as modules which are easy to assemble and interconnect.

Another problem associated with conventional manufacturing of cold appliances, is that it involves high investment costs for development of product lines and the like. This results in a very poor flexibility, primarily with regard to the possibility of producing cold appliances having different dimensions and variable equipment options in small series. Normally, new product designs necessitate large production series to be feasible for economic reasons. This also has to effect that the producers are unwilling to develop products having a new approach since the economic risk is so large, with a uniformed product line as a result, alternatively that a more odd product will be very expensive to produce and purchase.

Another problem associated with a modular cold appliance is how to arrange a condensation preventing device at the front of the cold compartment(-s). In a non-module cold appliance that is conventionally manufactured, as disclosed in U.S. Pat. No. 6,666,043, a condensation preventing device is arranged as a heat carrier tube extending along a front frame portion, which surrounds the cold compartment (-s) of the cabinet. The tube is filled with a heat carrier fluid, and is provided with a heat exchanger box, which is placed under a compressor included in the cooling system of the cold appliance. In U.S. Pat. No. 6,666,043 there is no information about how the tube is actually mounted at the front frame portion, but on the other hand there is no problem involved in the mounting thereof. To the contrary, when the cold appliance is not completed in the originating factory, but delivered in pieces and assembled on arrival, a problem arises of how to manufacture the pieces in order to facilitate the assembly.

When building a cold appliance in the conventional way, where the cabinet is built on site it is easy to obtain complex built in functions. However, when providing separate parts which are going to be mounted later on, new solutions are needed. One problem to be solved is how to obtain the complex interface between the cabinet and the door, where for example the above mentioned condensation preventing device is to be mounted.

In conventional cold appliances the evaporator is formed as a rather flat and rectangular device, which is mounted inside of the cabinet. The present invention is within the field of dynamic cooling, where the cooling module is a separate module which comprises all cooling devices, including the evaporator, and is subsequently assembled with the cabinet. Then the cooled air is circulated within the cabinet in order to cool the food. The air is cooled by having it pass through or around the evaporator, depending on its construction, by means of a fan. Then the conventional rectangular and rather flat shape is not optimal.

When manufacturing separate cabinet panels which are to be subsequently mounted, instead of manufacturing a cabinet shell and fill it with foam, it should be possible, and would be desirable to find a way to automate this manufacture, at least for some of the types panels involved.

In a cold appliance where the cooling effect is generated by a cooling module according to a self-contained type, and is distributed by an air flow inside the cabinet, it is a desire to make the cooling module compact. In order to make the cooling module as compact as possible it would be desirable to arrange the largest parts, i.e. the evaporator and the compressor beside each other, though of course thermally insulated from each other. This placement may result in that at least a part of the evaporator is positioned lower than an upper portion of the compressor. This mutual positioning will have some negative impact on the defrost system, i.e. the system which effects warming of the evaporator for melting of frost and ice aggregated thereon, drainage of the resulting defrost water, and evaporation of the defrost water. Conventionally, the defrost water is evaporated from a basin on top of the compressor as the warm compressor casing is heating up the water. The water is led by gravity from the evaporator to the basin by a tube or the like. However, when the evaporator, at least partly, is positioned lower than the compressor, this is not a possible solution. Consequently, there is a need of another solution.

Furthermore, when placing the cooling module below the cabinet, which is desirable in many applications, there are air ducts for circulating air to and from the cabinet may cause warming of the cold compartment of the cabinet when defrosting the evaporator, due to warm air rising, by natural convection, through the air duct normally delivering cold air. A straight forward solution would be to restrict this heat leakage by providing air shutters in the air ducts, which will close the air ducts during the defrost periods. A drawback with such a solution is that it necessitates the arrangement of more movable parts as well as control equipment, which will increase the costs for the cooling module.

In a modular cold appliance where a system for forced air circulation in the cold compartment(s) of the cabinet is necessary there arises a need for providing an efficient circulation of the air.

SUMMARY OF THE INVENTION

An object of the present invention is to provide a cold appliance alleviating the above-mentioned problem which arises when the evaporator is at least partly arranged below the compressor.

The object is achieved by a cold appliance according to the present invention as defined in claim 1. Advantageous improvements of the cold appliance are achieved in accordance with the dependant claims of claim 1.

Thus, there is provided cold appliance comprising a cooling module, and a cabinet, which comprises a cold compartment, wherein the cooling module comprises an air outlet delivering cooled air to the cold compartment, and an air inlet receiving air from the cold compartment. The cooling module is arranged at the bottom of the cold appliance, and it comprises a cold section, a warm section, which is separated from the cold section by an insulating wall, an evaporator arranged in the cold section, and a compressor and a condenser arranged in the warm section. The condenser comprises a condenser tube, which is arranged in windings on, or is integrated with, a bottom plate of the cooling module.

Thereby a heat generating device, i.e. the condenser tube, is available at a bottom level of the cooling module, which is usable for purposes of evaporating the defrost water.

In accordance with an embodiment of the cold appliance the cooling module comprises a drain water tray, which is arranged adjacent to the condenser tube, and which receives defrost water from the evaporator. This is an advantageous way to use the heat generated by the condenser tube for evaporating the defrost water, in combination with cooling the condenser tube efficiently.

In accordance with an embodiment of the cold appliance the drain water tray is constituted by a portion of the bottom plate. This is a simple realization of the drain water tray, where the basic structure of the cooling module is employed.

On the other hand, in accordance with an embodiment of the cold appliance, the drain water tray is constituted by a separate tray arranged on top of the condenser tube.

In accordance with an embodiment of the cold appliance the cooling module further comprises a defrost water collecting plate arranged below the evaporator, and a draining pipe extending from the defrost water collecting plate to the drain water tray, and guiding the defrost water to the drain water tray. Thereby the defrost water is safely collected and transported between the cold section to the warm section with a minimal impact on the thermal partitioning between the sections.

In accordance with an embodiment of the cold appliance the condenser tube is arranged inside the drain water tray, whereby its heat is effectively transferred to the water.

BRIEF DESCRIPTION OF THE DRAWINGS

An embodiment of a modularly composed cold appliance including the invention, will hereinafter be described by way of example with reference to the accompanying drawings, in which:

FIG. 4 is a partial cross section along A-A in FIG. 1*a* of a third embodiment of the joints according to FIG. 3;

FIG. 5 is a partial cross section along A-A in FIG. 1*a* of a fourth embodiment of the joints according to FIG. 3;

DETAILED DESCRIPTION OF AN EMBODIMENT OF A MODULAR COMPOSED COLD APPLIANCE INCLUDING THE INVENTION

Figure 1B:
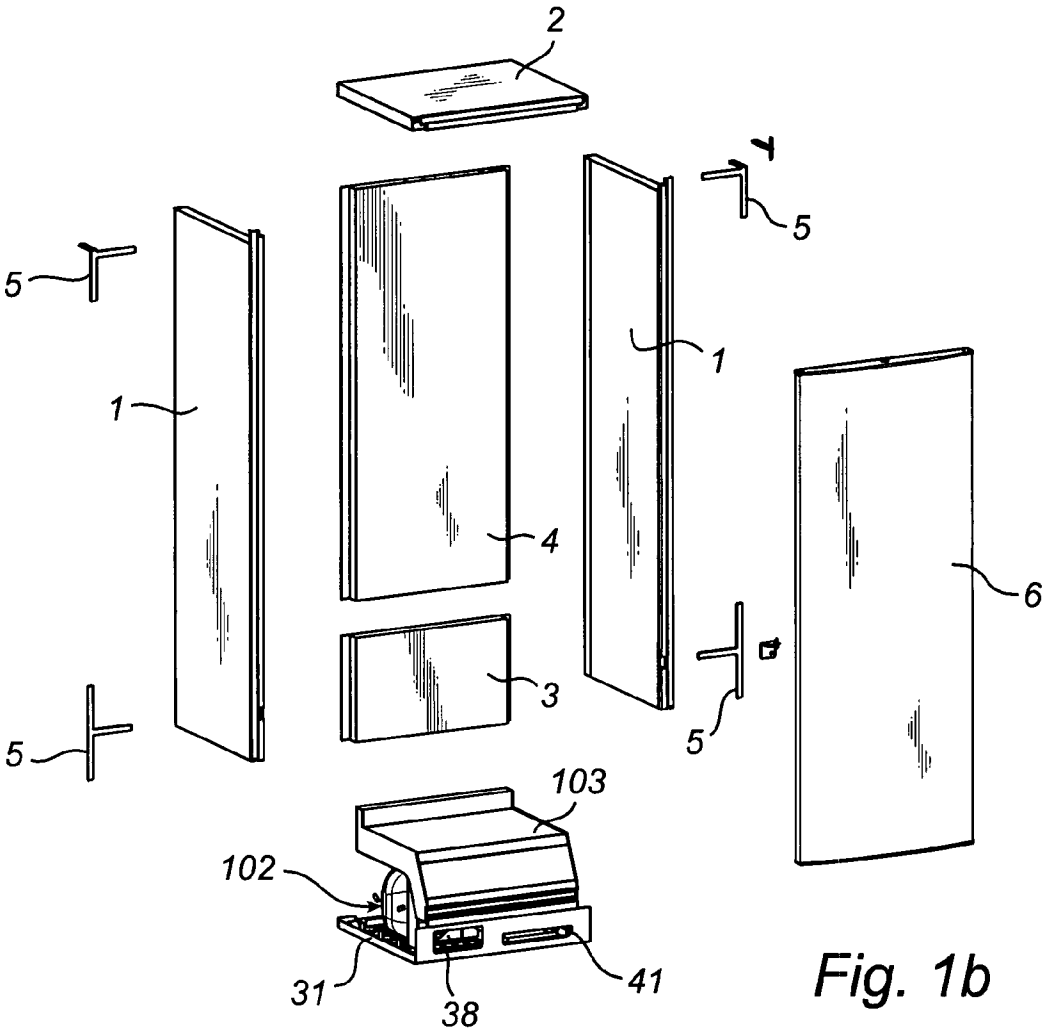
FIG. 1*b* is an exploded perspective view of the cold appliance according to FIG. 1*a;*
Figure 1A:
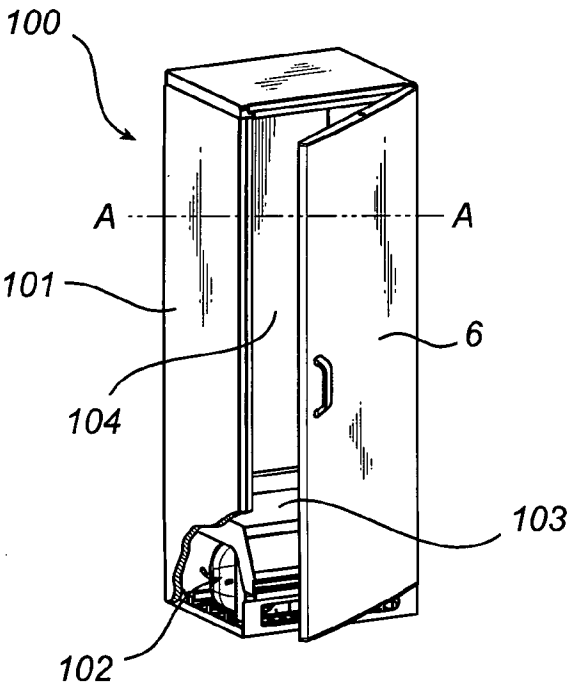
FIG. 1*a* is a partial cut-away perspective view of an embodiment of a cold appliance assembled from modular units according to the present invention.

FIG. 1*a* is a partly cut off perspective view of a modularly built up cold appliance, i.e. a refrigerator or a freezer, or a combination thereof. By combination is meant a cold appliance having a separating thermally insulating section that divides the cold space into a separate freezer compartment and a separate refrigerator compartment. In this embodiment the appliance has a single function of freezer or refrigerator. The cold appliance 100 comprises a cabinet 101 and a cooling module 102, which is positioned beneath an inner floor 103 of the cabinet 101. Although not shown, the cold appliance typically comprises interior fittings, such as shelf supports, shelves, boxes, and lockers; a control panel; lights; cabling; sensors; etc.

FIG. 1*b* is an exploded perspective view of the modularly built up cold appliance 100, which comprises the cabinet 101 made up of a number of cabinet panels, consisting of two side wall panels 1, a top panel 2, and a lower and an upper rear wall panel 3, 4, as well as reinforcing fittings 5. The cold appliance also comprises a door 6 and the cooling module 102 including for example a compressor, a condenser, an evaporator, a fan, and the like, which are necessary for obtaining the cooling effect. The cooling module 102, which will be described in more detail below, is formed as a self-contained or stand alone module, which can be easily mounted into the cabinet 101 and connected to a mains supply. In this embodiment the cooling module 102 is arranged at the bottom of the cabinet 101. The cooling module 102 has a bottom plate 31, which is also the bottom plate of the cold appliance as a whole. The cabinet is supported by the bottom plate 31. More particularly, the side wall panels 1 are mountable on the bottom plate 31. Furthermore the bottom plate 31 comprises wheels, or rollers, 110, or as an alternative, or in combination with the rollers 110, levelling feet. The lower back wall panel 3 is openable, or demountable, in order to admit access to the cooling module 102 for service purposes. In an alternative embodiment, the cooling module is located in a different position in the cabinet, e.g. in the top. In yet another embodiment the cabinet is provided with a separate bottom panel, which constitutes the inner floor, and the cooling module is placed beneath that floor while being retractable or accessible for service. Thus, the top most and the lower most delimiters of the cabinet can be defined as top part and bottom part, since they can be either separate panels or parts of another structure, such as the cooling module.

Figure 19A:
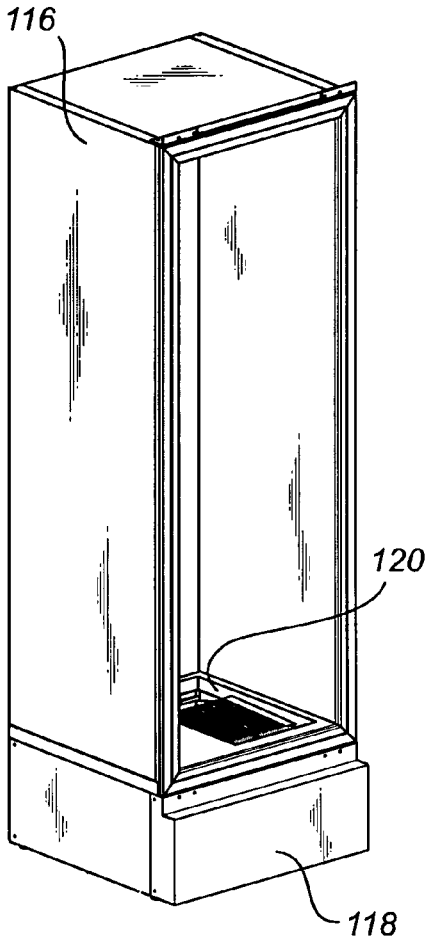
FIGS. 19*a* and 19*b* are perspective views of an embodiment of the cold appliance.
Figure 19B:
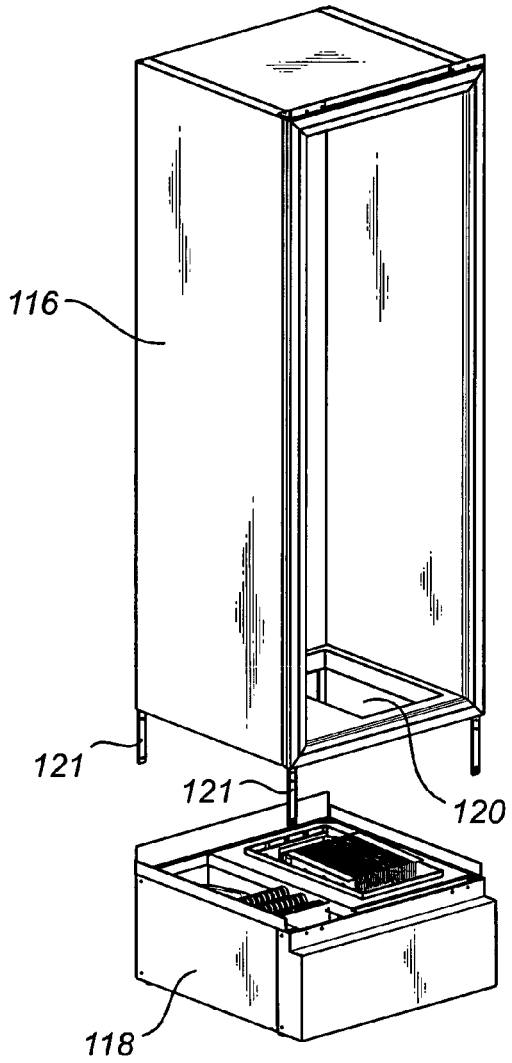

In another embodiment, as shown in FIGS. 19*a* and 19*b*, the cabinet 116 is assembled from top, side wall, rear wall and bottom panels, and is provided with bottom connection elements 121 for connecting it with the cooling module 118 arranged beneath the cabinet 116. In order to facilitate service of the cooling module 118, in particular the cold section 34, the bottom panel of the cabinet 116 is provided with a hatch 120, which is illustrated in an open position.

In the embodiment of the cold appliance illustrated in FIGS. 1*a* and 1*b*, the door 6, the top panel 2 and the inner floor panel 103 are manufactured by a method common in the art, such as by conventional foaming in situ, whereas the side wall panels 1 and the rear wall panels 3, 4 are manufactured by a method, which will be described in more detail below. It is to be understood however, that in alternative embodiments also one or more of the door 6, the top panel 2 as well as the inner floor panel 103 could be manufactured by the method according to the present invention.

Preferably, the panels 1, 2, 3, 4, 103 are interconnected by means of an adhesive, or glue, which provides strong as well as tight joints. Additionally, the glued joints provide thermally good properties. Furthermore, the tightness of a glued joint ensures a high hygienic level of the cold appliance, which typically will contain foods. The reinforcing fittings 5 are mounted in the corners between the side wall panels 1 and the top panel 2 as well as the inner floor panel 103. The fittings 5 are glued to the surfaces or attached by means of appropriate fastening elements. The fittings 5 will give strength to the cabinet 101 during use as well as during curing of the glue, which preferably is used to attach the panels to each other. The fittings are also utilized as reinforcement parts for attaching e.g. door hinges or the like. It should be noted though that, as will be further explained herein, it may not be necessary to add the fittings. The cabinet may achieve a high enough stability without them as well.

Figure 2:
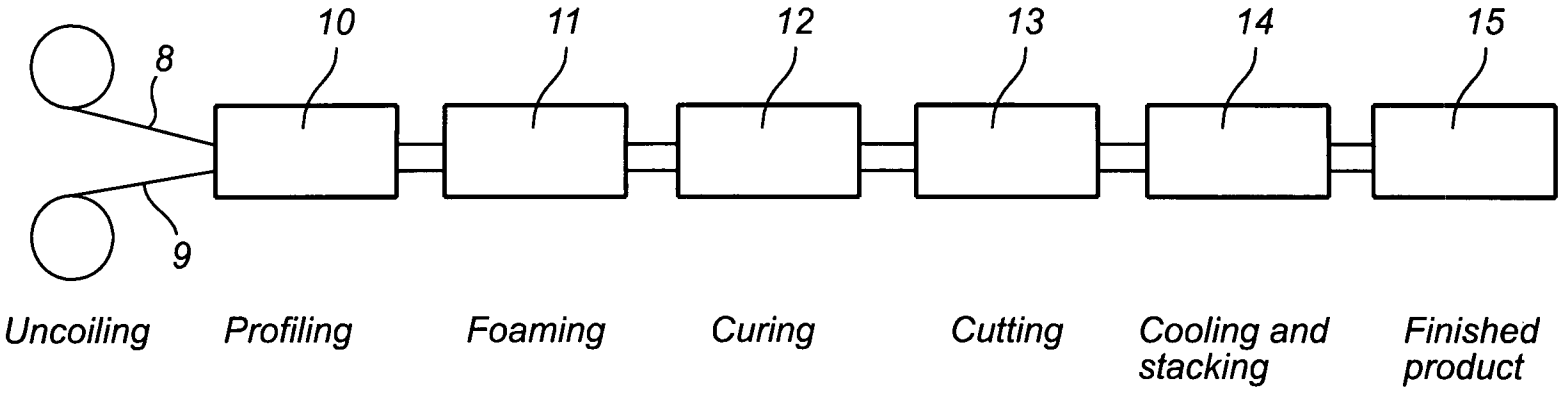
FIG. 2 is a flowchart which schematically illustrates an embodiment of a method of manufacturing cabinet panels according to the present invention.

According to the herein described and illustrated embodiment, the side wall panels 1 and the rear wall panels 3, 4 of the cabinet, are formed by a panel manufacturing method, as is illustrated in a schematic flowchart in FIG. 2. An upper and a lower sheet material, e.g. a metal sheet 8 and a plastic sheet 9, a metal sheet 8 and a metal sheet 9, or a plastic sheet 8 and a plastic sheet 9, respectively, are fed from upper and lower sheet rollers in an inlet end to a sheet forming and foam application machine. The sheet layers are initially held on a rather large distance from each other as they are fed from the inlet end towards an outlet end. In a first profiling station 10 the sheets are profiled to a desirable profile shape, such as bending the longitudinal edges inwards, for example to a right angle with the rest of the sheet, forming grooves by curving the sheet inwards or forming ribs by curving the sheet outwards, as is to be explained more in detail below, and in order to obtain for example the embodiments described above. Subsequently, at a foaming station 11, a continuous double belt foaming process is performed. The process comprises that the web of sheet material is passed through the foaming station 11 and a desirable amount of thermally insulating foam, e.g. polyurethane foam, is dispensed over the lower sheet surface in the space between the sheet layers. Thereafter, the sheet layers are brought closer to each other to establish the desirable thickness of the sandwich panels. The foam is then cured in a curing station 12. The continuous sandwich web is then cut into cabinet panels of desirable lengths in a cutting station 13. In the cutting station 13 the sheets and the foam can be cut at different lengths, which is advantageous for mounting purposes as will be described below. Thereafter, the panels are cooled 14. The cooling process is controlled in order to prevent buckling of the panels. Any additional attachment parts can be mounted on the cooled cabinet panels, such as assembly fittings, shelf supports or profiled bars along one or more of the edges to obtain a finished modular cabinet panel 15 ready for transportation and subsequent assembling to form a cold appliance cabinet.

As an alternative, before the foaming operation the sheet materials are prepared for mounting of said additional attachment parts at a later stage. Thus, the sheet materials are provided with borings and the like which are to be used for mounting the attachment parts. Optionally, the sheet materials are also provided with fastening details, such as reinforcement elements, screw seats, etc., on their surfaces facing the interior of the cabinet panels to be. During the following foaming these details are embedded by the foam.

The method of manufacturing panels is advantageous in many respects. For example, the energy requirements on a cold appliance are high, and will probably increase even more in the future. By means of this method a good foam filling of the cavities is ensured. The risk of air bubbles and non-filled cavities is reduced in comparison with conventional injection moulding. Furthermore the insulating property is higher. It is possible to choose a certain orientation of the foam. All in all these advantages provide for a minimum thickness of the insulation, i.e. the foam, and thus of the panels.

Figure 16:
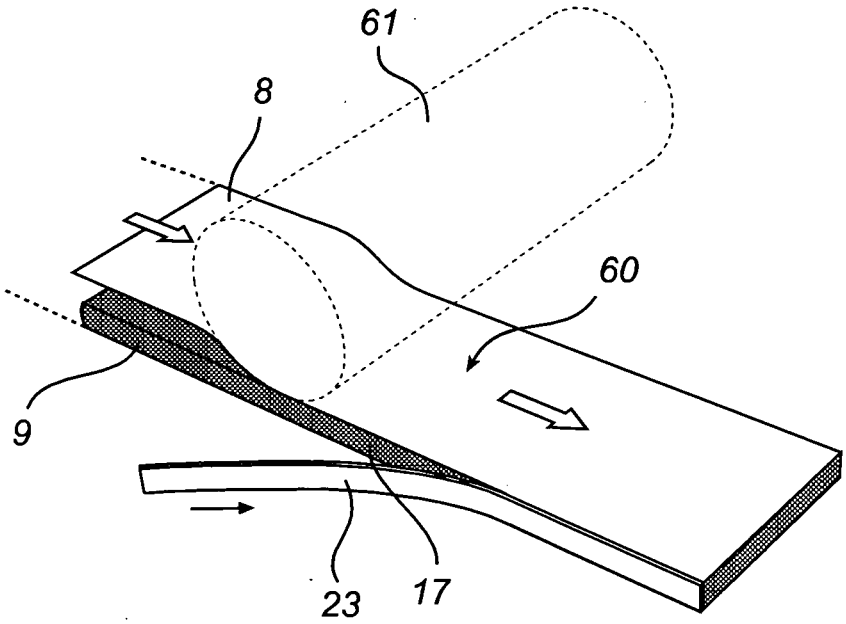
FIG. 16 is a perspective view illustrating the manufacture of cabinet panels.

As shown most schematically in FIG. 16, in an alternative embodiment of the manufacturing method a profiled bar 23 is inserted along at least one of the edges of the sandwich web 60. The profiled bar 23 as such will be further described below in conjunction with FIG. 6. Thus, when, at the foaming station, the foam 17 has been applied between the top sheet 8 and the bottom sheet 9, and the upper sheet 8 has been brought closer to the lower sheet, e.g. by means of a forming roller 61 as shown by dashed lines in FIG. 16, the profiled bar 23 is applied from the side of the sandwich web 60 and attached thereto. The attachment can be made in many different ways, and preferred ones are described below. However, typically there is a combination of the bar 23 having an elongate rib extending along the length of the bar 23, and entering a groove, which has been formed in a portion of one of the sheets, and adhesive contact between the bar 23 and the non-cured foam 17. An advantage of this embodiment is that the time for mounting the cabinet is reduced.

When assembling the cabinet, the cabinet panels may be connected to each other in different ways. For example; by at least one of gluing, screw fitting, and riveting. Preferably, the outer sheet layer 8 is a painted metallic sheet whereas the inner sheet layer 9 is a plastic sheet but also other variants could be conceivable, such as plastic sheets or metallic sheets on both the inner and outer surface. In FIGS. 3 to 5 different exemplary embodiments of joints between the side wall panels and the rear wall panel are disclosed. One common feature of all of the joints disclosed in FIGS. 3 to 5 is that the outer sheet 8 of at least one of the wall panels 1 extends beyond the edge surface 16 of foamed material 17 and has been bent, in the panel manufacturing as described above, over the edge surface to wholly or partially cover the edge surface of foamed material. The extending edge portion of the sheet 8 provides an attachment area for attachment of a neighbouring panel, Hereby the wall panel has a sheet layer bonding area for the connection between the wall panels 1, which can be utilized for obtaining a resistant bonding by means of gluing and/or screwing of the wall panels 1 to each other. Within this general idea, the joint can be realized in many different ways and four different exemplary embodiments are disclosed in FIGS. 3 to 5.

Figure 3A:
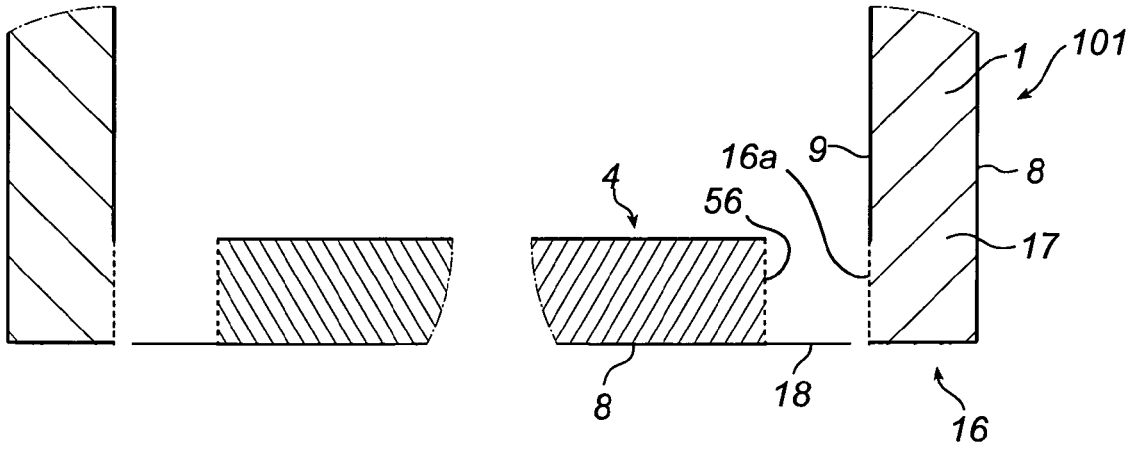
FIG. 3*a-b* is a partial cross section along A-A in FIG. 1*a* of a first embodiment of the joints between the side cabinet panels and the rear cabinet panel of the cold appliance cabinet.
Figure 3B:
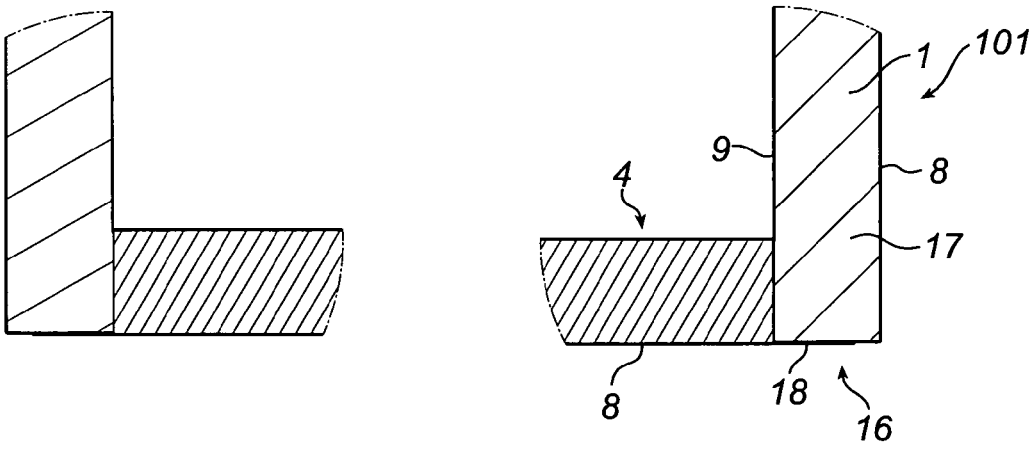

In FIG. 3*a* showing the side wall panel 1 and the rear wall panel 4 before they are joined, the outer metallic sheet 8 of the side wall panel 1 extends beyond and has been bent over the longitudinal edge surface 16, whereas the inner plastic sheet 9 is terminated on a distance from the same longitudinal edge surface such that the foam 17 will be exposed on the inner side along the edge 16*a*. The rear wall panel 4, on the other hand, is provided with an extended portion 18 of the outer metallic sheet 8 but is not bent over the edge surface. Instead, the metallic sheet is left projecting from the edge surface. Accordingly, when connecting the two wall panels 1, 4 perpendicular to each other, an overlapping portion is formed between the outer metallic sheets 8 such that they can be connected to each other, preferably by means of gluing in combination with screwing to fixate the wall members together while the glue is curing. In FIG. 3*b* the side wall panel and the rear wall panel has been joined. The foam to foam contact surfaces 16*a*, 56 are suitably also glued to each other, on one hand for bonding purposes but also for providing an air and moisture tight joint. The foam to foam contact between the cabinet panels prevents forming of any thermal bridge from the inside to the outside of the cabinet. However, it would also be conceivable to extend the inner sheet of the side wall panel a distance and to extend and bend the inner sheet of the rear wall panel a distance over the edge surface and glue them together for increased bonding strength, as shown in FIG. 3*c-d*.

Figure 3C:
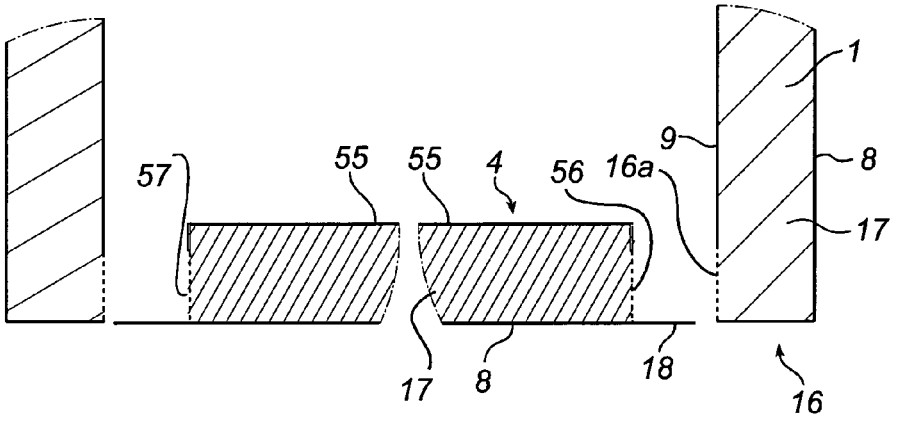
FIG. 3*c-d* is a partial cross section along A-A in FIG. 1*a* of a second embodiment of the joints according to FIG. 3*a-b;*
Figure 3D:
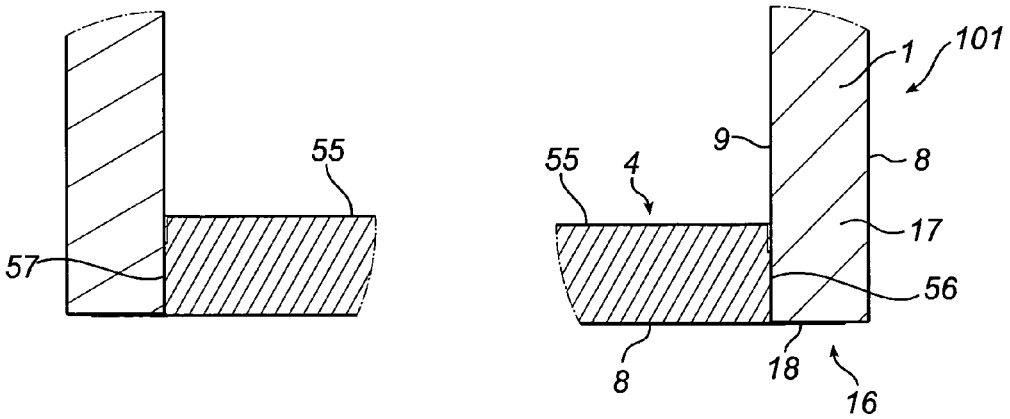

Thus, in FIG. 3*c-d* is disclosed a joint where, in addition to the joint of FIG. 3*a-b*, the inner sheet 55 of the rear wall panel 4 has been bent over each respective longitudinal edge surface 56, 57, thereby covering a fraction thereof, see FIG. 3*c*. In FIG. 3*d*, the inner sheet 9 of the side wall panels 1 has been extended along with and attached to the bent portion of the rear wall inner sheet 55. This extra sheet to sheet bond increases the strength and stability of the cabinet.

In FIG. 4 is disclosed a joint where the outer sheet 8 of the side wall panel 1 extends over the edge surface and has been bent over the edge surface 16 as well as a distance over the inner surface. Also the outer sheet 8 of the rear wall panel extends a distance over the edge surface and is bent over the edge surface. Moreover, both the side wall panel as the rear wall panel are each provided with an elongated groove 19 in the edge surface and the outer surface, respectively, along the abutment area between the wall panels, wherein each groove is formed by the outer sheet 8 being curved shaped into the foam material 17. These elongate grooves are utilized for connection by means of a connection strip 20, preferably of plastics, being provided with two spaced apart rib portions, which have a shape mating with the grooves and are inserted into the grooves for connecting the wall panels together. The fixation of the connection strip with the grooves can be achieved by means of e.g. snap fit connection, gluing or screwing, preferably by a combination of two or more of these. Also the bonding area provided by the bent over outer sheets in the abutment area between the wall panels, is utilized for bonding by means of gluing for increased strength.

In FIG. 5 is disclosed a further embodiment of a joint between cabinet panels. Here, similar to the embodiment in FIG. 4, the outer sheet 8 of the side wall panel extends over the edge surface 16 as well as a distance over the inner surface, whereas the outer sheet of the rear wall panel 4 extends a distance over the edge surface. However, no grooves are provided on the outside of the cabinet. Instead an elongated groove 21 is provided in the edge surface of the rear wall panel, i.e. in the abutment surface between the wall panels, by curving the outer sheet into the foam material 17. The side wall panel 1, on the other hand, is provided with an elongated rib 22 by curving the outer sheet outwards in the abutment surface between the wall panels. By a snap fit connection of the rib into the groove in combination with gluing, a secure connection of the wall panels is achieved.

Figure 20A:
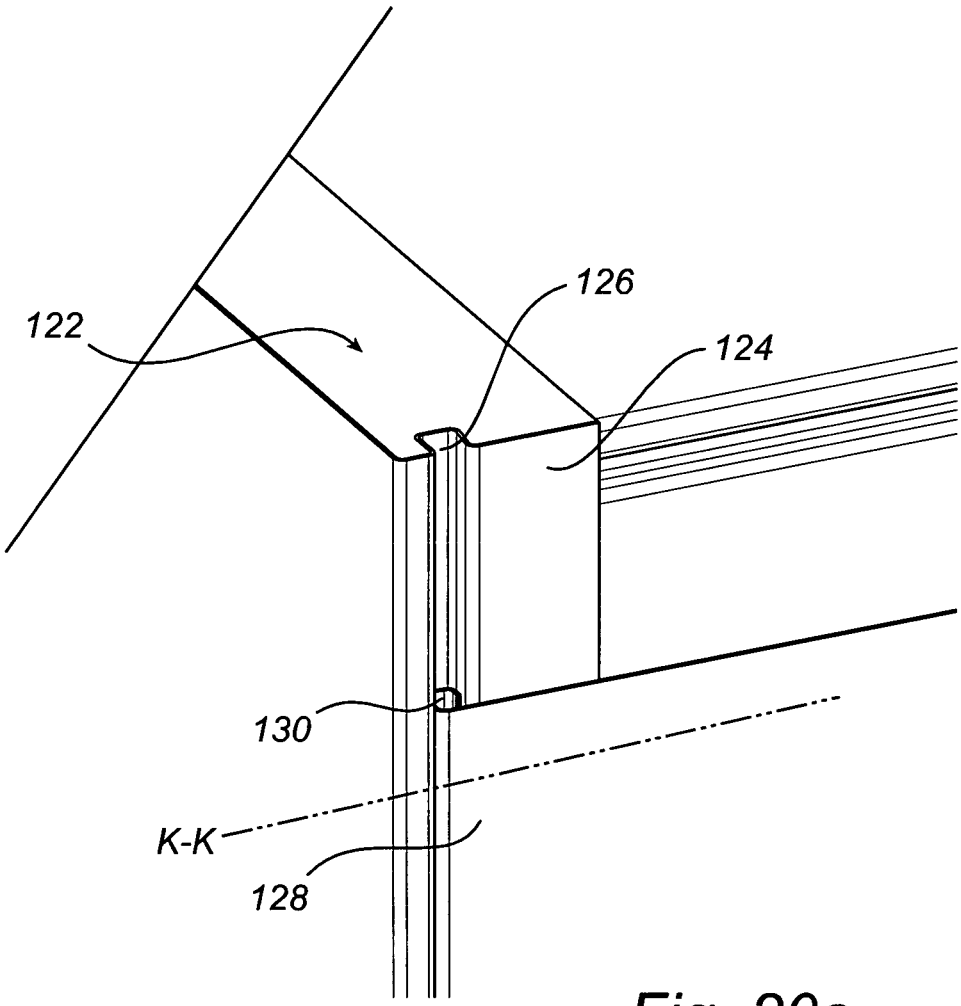
FIGS. 20*a* and 20*b* are a perspective view from behind and a cross sectional view along K-K respectively illustrating an embodiment of a joint between cabinet panels.
Figure 20B:
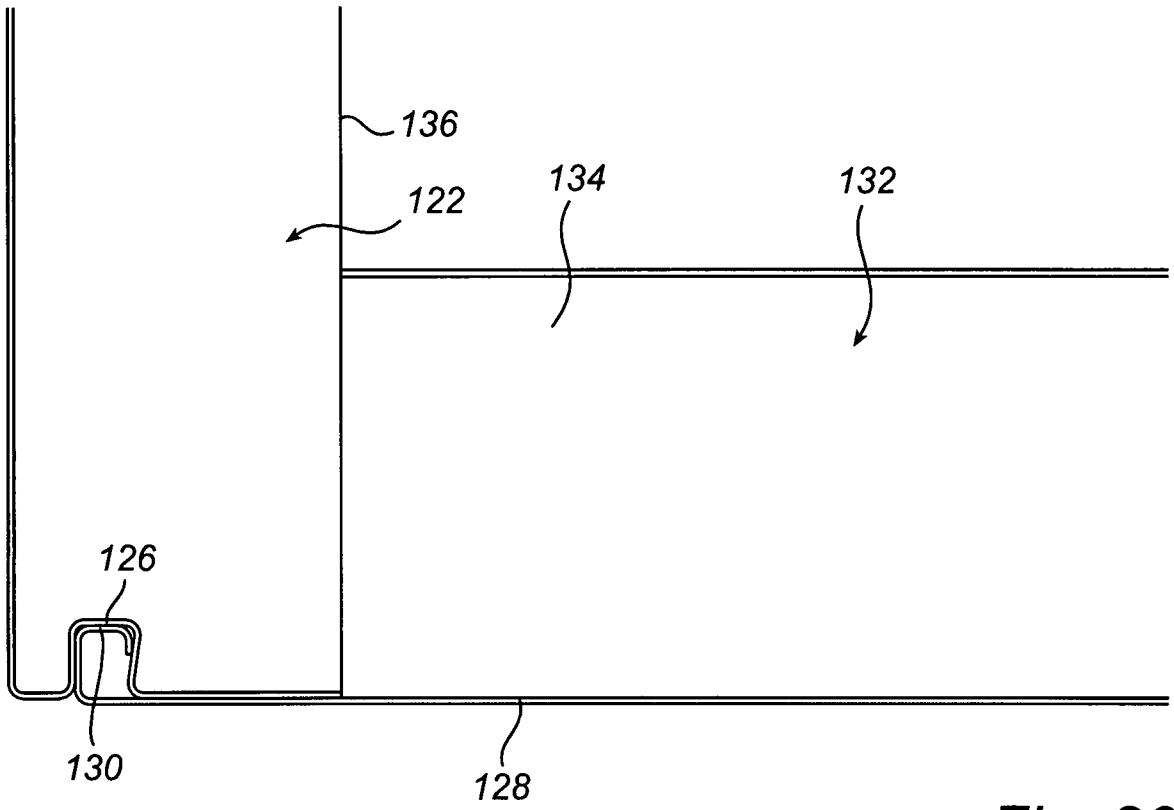
Figure 21:
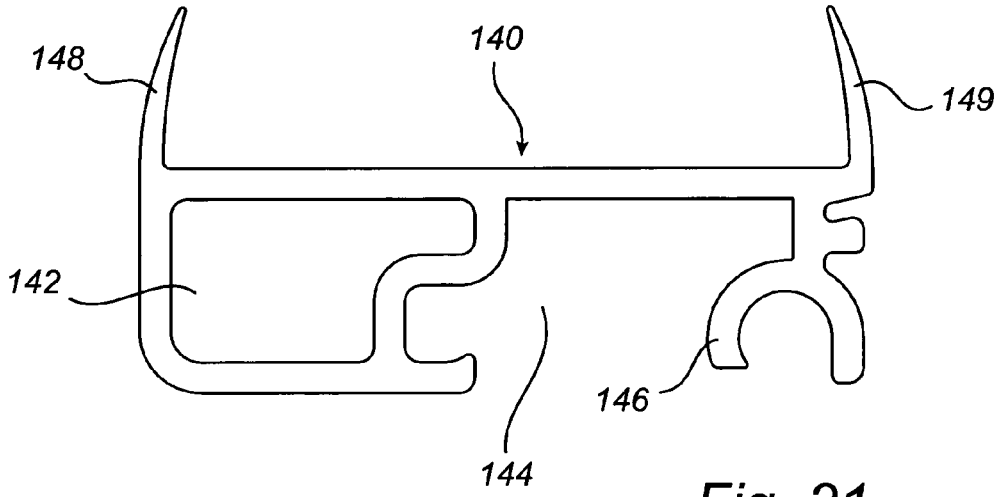
FIG. 21 is a cross sectional view of a profiled front bar.

In accordance with another embodiment of the joint between cabinet panels, as shown in FIGS. 20*a* and 20*b*, an edge portion 124 of the outer sheet of the side wall panel 122 has been bent and covers the rear edge surface of the panel 122. An elongated groove 126 has been formed in the edge portion 124. This groove 126 is wider at the bottom thereof than at the top thereof. The outer sheet 128 of the rear wall panel 132 has an edge portion that extends beyond the edge surface of the foam material 134 of the rear wall panel 132. An edge most sub-portion 130 of the edge portion of the outer sheet 128 of the rear wall panel 132 has been bent into a shape conforming with the groove 126, and more particularly a shape that at least follows one side wall and the bottom wall of the groove 126, and in this embodiment also a fraction of the other side wall of the groove 126. The edge most sub-portion 130 has been received in the groove 126 and locks the rear wall panel 132 to the side wall panel 122 because the groove 126 is narrowing from the bottom thereof towards the opening thereof. The edge surface of the rear wall panel 132, i.e. inter alia the edge surface of the foam abuts against the inner sheet 136 of the side wall panel 122.

All the wall panels described in relation to FIGS. 3 to 5, having extended outer sheets being projecting or bent over the edge surface and also a distance over the inner surface, having grooves or ribs, can be manufactured in a continuous process including a double belt foaming process as previously described.

Figure 18:
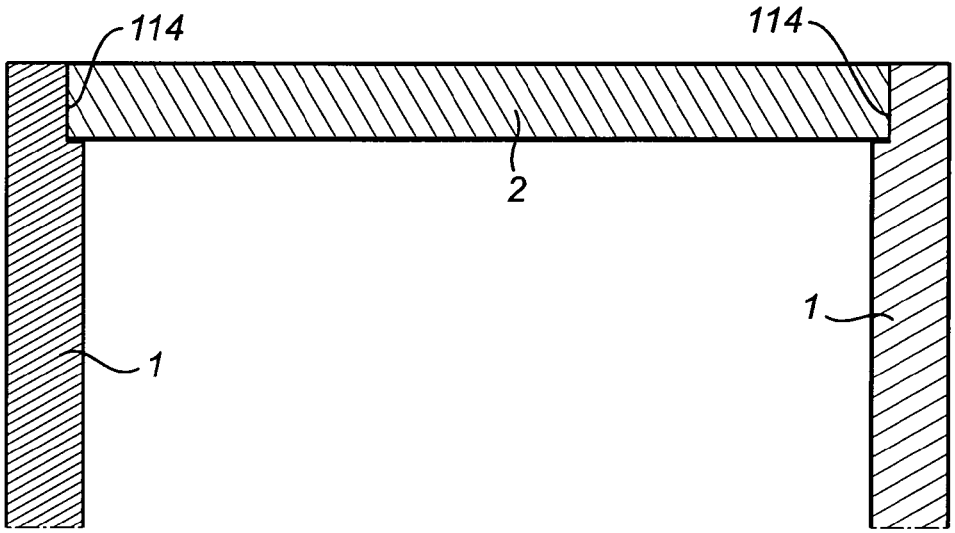
FIG. 18 is a cross section along H-H in FIG. 14 of a top portion of an embodiment of the cabinet.

A top panel is preferably attached to the side wall panel and the rear wall panel by gluing. In this way the stability of the cabinet will be enhanced and the air as well as moisture tightness will be ensured. The joints can be formed according to the embodiments disclosed in FIGS. 3 to 5, but other ways are of course also possible. For example, as shown in FIG. 18, each side wall panel 1 is provided with a machined top end groove 114 forming a shelf on the inside of the side wall panel 1. The top panel 2 is received in the respective grooves 114 and rests on the shelves.

It is sometimes desirable to form the cabinet with a separating mid wall panel, to divide the space into two different compartments having separate doors, e.g. for forming separate freezer and refrigerator compartments, or to arrange fixed shelves inside the compartments. It is also here advantageous to glue the mid wall panel or the fixed shelf to the inner surfaces of the cabinet. In the herein described and illustrated embodiment, the cooling module forms the bottom of the cabinet and preferably the cooling module is glued to the side wall and rear wall panels.

Figure 6:
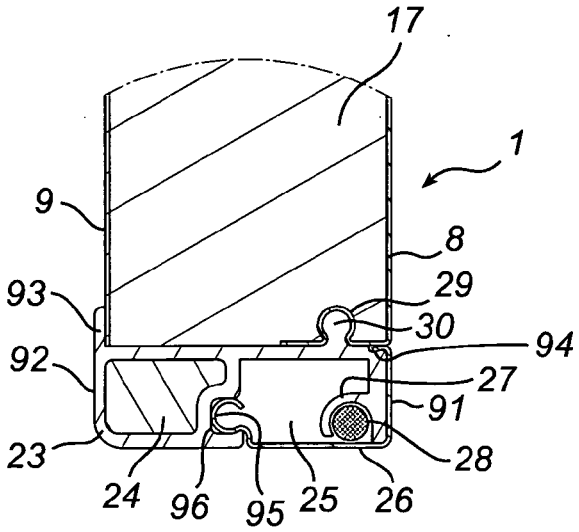
FIG. 6 is a cross section along B-B in FIG. 7 through the front edge of a side wall panel.
Figure 7:
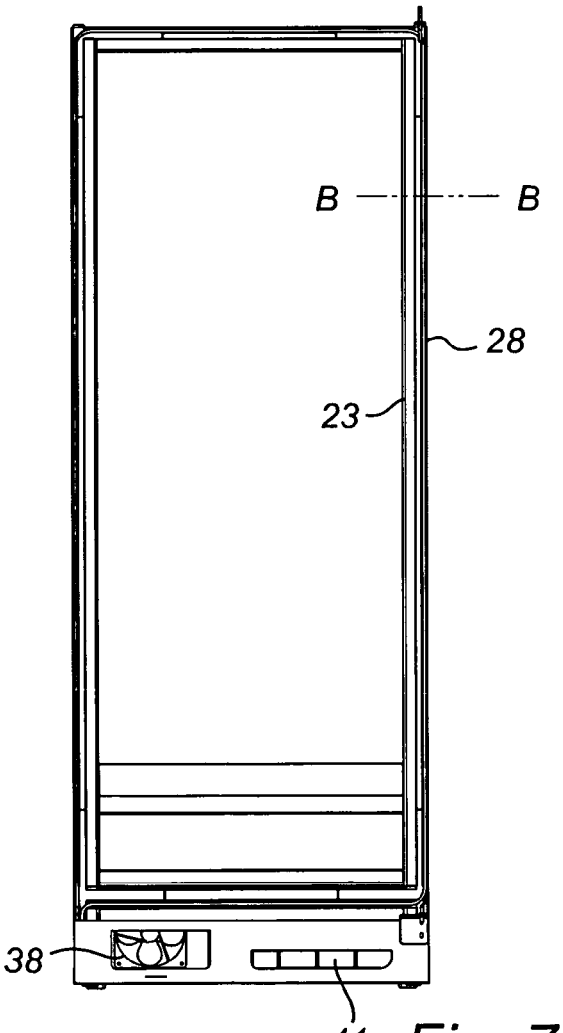
FIG. 7 is front view of the assembled cabinet with the door removed showing the location of the thermosiphon tube around the cabinet opening.
Figure 9:
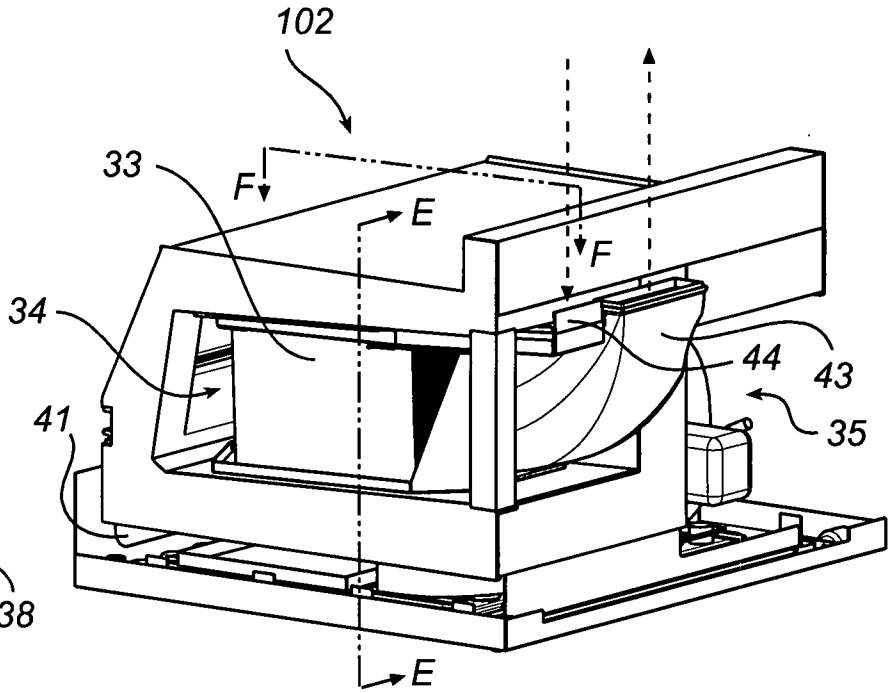
FIGS. 8 and 9 are perspective views of the cooling module from the left rear side and right rear side, respectively.
Figure 8:
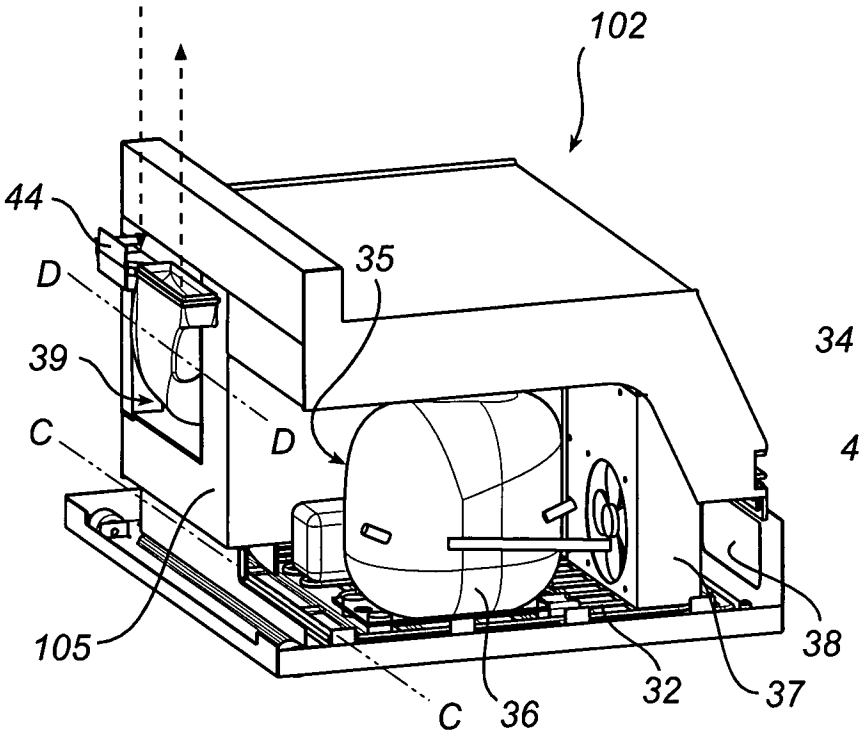

Reference is now made to FIG. 6 in which a fraction of the front frame portion of the cabinet is shown in cross section, i.e. a portion of the cabinet which surrounds and defines the opening in the cabinet. Here, the cabinet is provided with a profiled bar 23, preferably of plastics. The profiled bar 23 is arranged on the front frame portion, i.e. it extends around the opening of the cabinet, as shown in FIG. 7. The profiled bar can be attached in different ways, such as by means of an adhesive, or as will be described below. The profiled bar has several purposes. Inter alia it functions as an abutment surface for the door, and decreases heat leakage from the ambient air into the cabinet. As is apparent from FIG. 6, the bar 23 has a basic cross sectional shape of a rectangle. The bar 23 comprises two separate recesses, or chambers, 24, 25 one of which 24 is adapted to be filled with foam to prevent entrance of humidity from the outside, and is located closer to the inner sheet 9 than the other chamber 25. In an alternative embodiment the first mentioned chamber is unfilled, i.e. filled with air, while the very ends of the bar are sealed. The other chamber 25 is unfilled and covered by a detachable elongate cover member 26, preferably of steel such that it can function as part of the magnetic lock by cooperating with a magnetic strip on the door. The cover member 26 is substantially L-shaped in cross-section and additionally covers an outer side 91 of the bar 23. At the opposite inner side 92 of the bar 23 the wall thereof is extended by a protruding lip, or wing, 93, which covers a portion of the inner sheet 9, and thereby it covers the transition between the inner sheet 9 and the rear wall of the bar 23, which is a hygienic solution. Inside the chamber 25 there is arranged an elongate, and U-shaped in cross section, support means, or holder, 27 for a thermosiphon tube 28 as will be explained below. For attachment of the profiled bar 23, the outer sheet 8 of the wall panel is extended and bent a distance over the edge surface of the wall panel 8. The extended portion of the outer sheet 8, defines an elongated groove 29 at a subportion thereof which has been curved inwards into the foam material 17. The rear side of the profiled bar 23, on the other hand, is formed with an elongated rib 30, which extends along the length of the bar 23 and fits into the groove 29. Accordingly, the profiled bar 23 can be securely as well as air and moisture tightly mounted to the front edge of the wall panels by gluing and snap in fit by the rib 30 in the groove 29.

Figure 10:
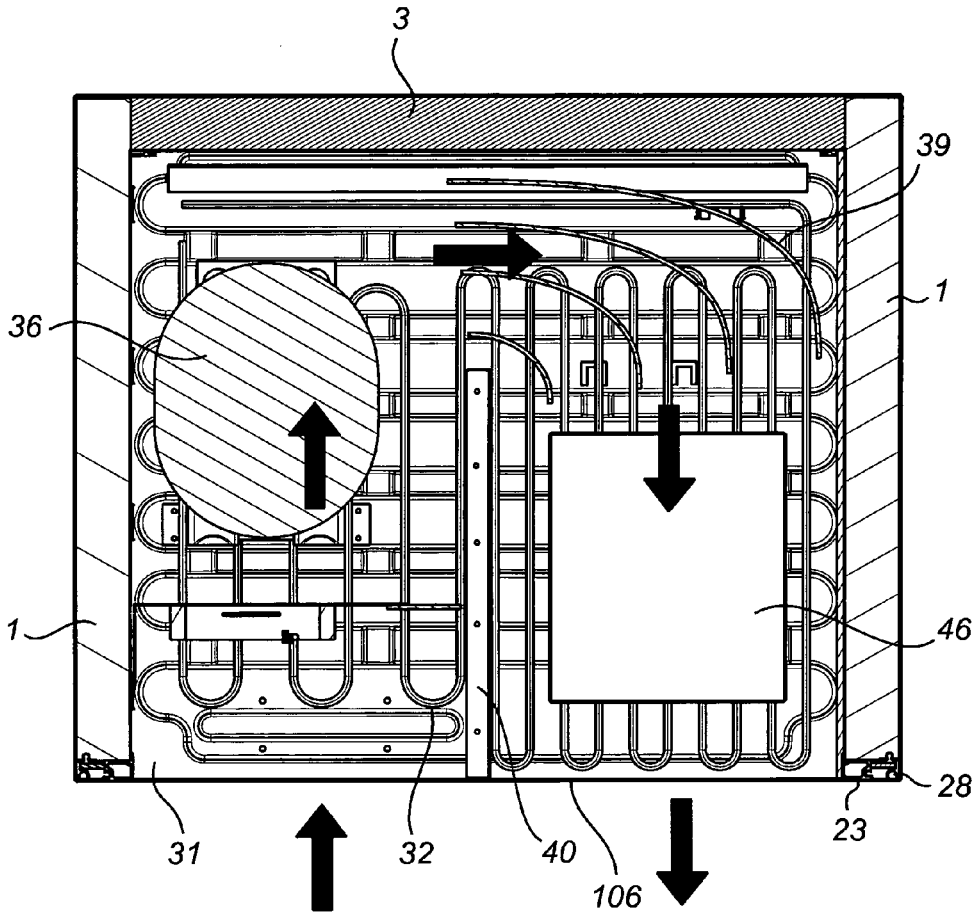
FIG. 10 is a partial cut-away view from above of the bottom plate of the cabinet showing the cooling module mounted in the cold appliance of FIG. 1*a* and the location of the various equipment and the air flow through the warm section of the cooling module along C-C in FIG. 8.
Figure 11:
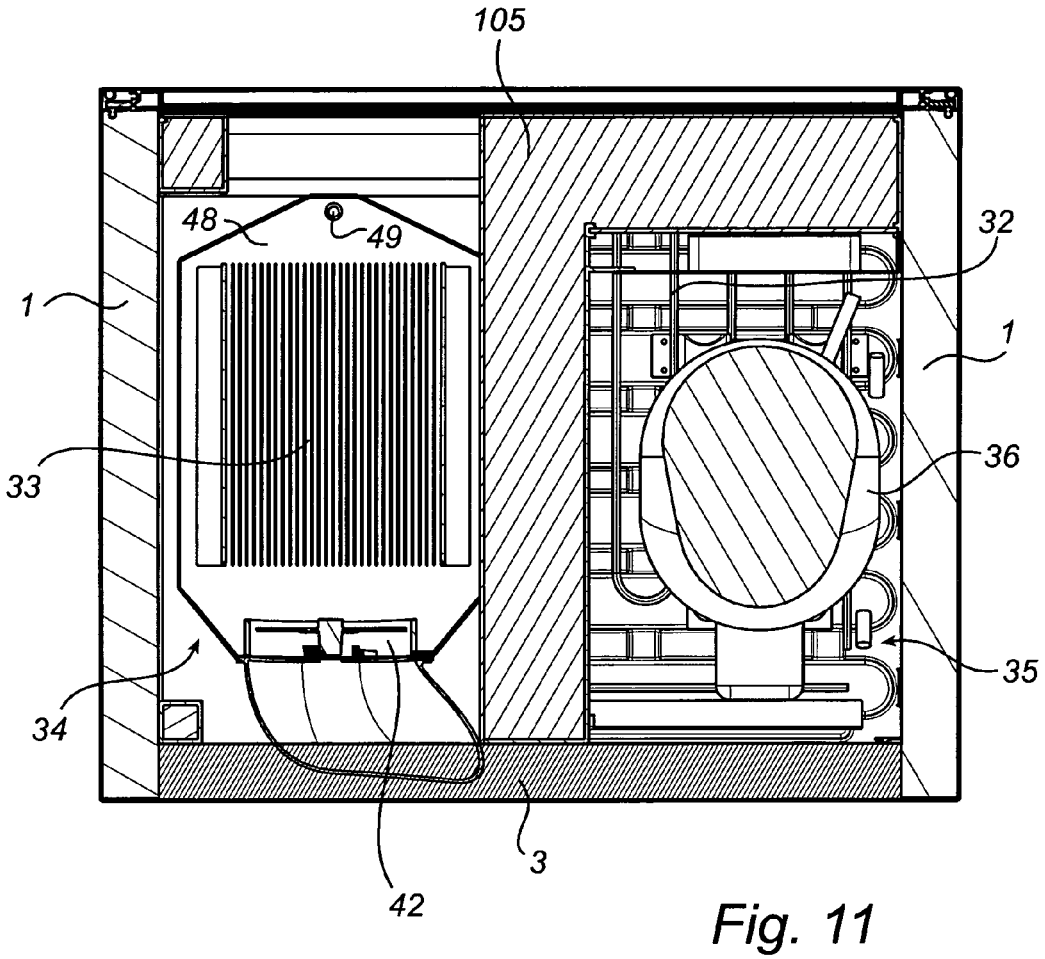
FIG. 11 is a partial cut-away view from above of the cold section as well as the upper part of the warm section of the cooling module mounted in the cold appliance of FIG. 1*a* and along D-D in FIG. 8.
Figure 12:
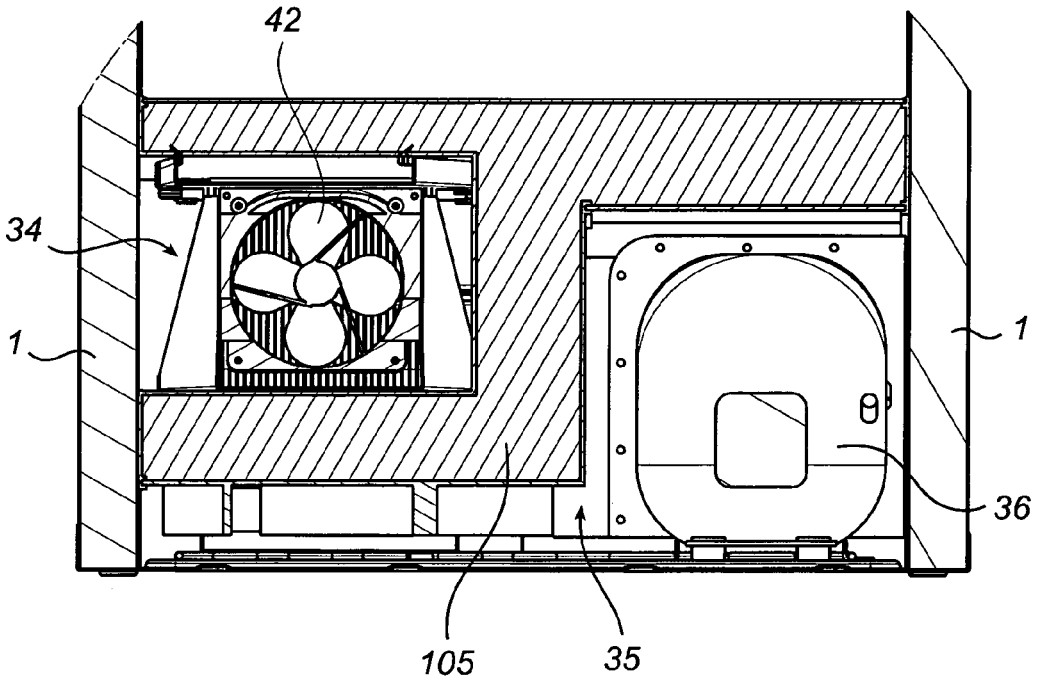
FIG. 12 is a cross section along E-E in FIG. 9 of the cooling module mounted in the cold appliance of FIG. 1*a* and through the evaporator fan as seen from behind.
Figure 17:
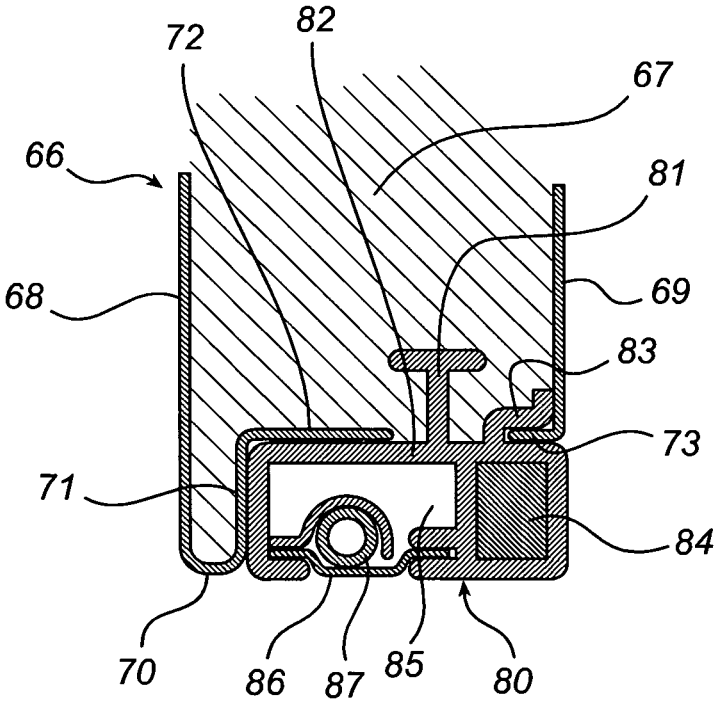
FIG. 17 is a cross section along B-B in FIG. 7 of a front portion of a wall panel and a profiled front bar.

The thermosiphon tube, or heat carrier tube, 28 is part of a condensation preventing device, which is a front frame heating system arranged to avoid condensation on cold surfaces close to the door of the cold appliance. In the illustrated embodiment the tube 28 is closed in an endless loop and located around the opening of the cabinet, as is illustrated in FIG. 7, where the cover member 26 has not yet been mounted. Due to the U-formed holder 27, it is easy to snap in the tube 28 into the holder 27 adjacent to the outer corner of the profiled bar 23 when assembling the cold appliance. Thereafter, the cover member 26 can be mounted by engaging one edge portion 94 of the cover member 26 around the rear corner of the outer side 91 of the profiled bar and snap a curved portion at the opposite edge portion 95 of the cover member 26 into a groove 96 of the profiled bar 23 inside of the open chamber 25. In this way the thermosiphon tube 28 will be located in contact with or at least close to the cover member 26 for heat transfer between the thermosiphon tube and the cover member. The thermosiphon tube 28 is filled with a suitable refrigerant and mounted in thermal contact with a heat source in the cooling module at the bottom of the cabinet. The heat source is typically the condenser tube or the compressor shell or, as in this embodiment, a metallic condenser plate 31, as is illustrated in FIG. 10, which forms the bottom of the cabinet and on which the condenser tube 32 is placed in windings for increased cooling. A boiler, see e.g. 176 in FIG. 22, of the thermosiphon tube 28 is placed on the condenser plate 31. Due to the raised temperature of the condenser plate, the refrigerant in the thermosiphon tube 28 will absorb heat from the condenser plate 31, when passing the boiler, and, at a certain temperature level, the refrigerant in the boiler starts to evaporate and circulate in the tube. When the refrigerant arrives at the colder areas around the door, it is condensed back into liquid giving off heat to the ambient parts, such that condensation and possible frost is prevented between the door and the front frame of the cabinet. As soon as the refrigerant has condensed, it flows back to the lower region of the cabinet and again absorbs heat from the condenser plate. There are many alternative shapes of the profiled bar, one of which is shown in FIG. 17. The profiled bar 80 according to this embodiment typically is mounted on the longitudinal edge of the wall panel 66 in conjunction with the manufacturing thereof by means of the panel manufacturing method, as described above. In this alternative embodiment an extended portion of the outer sheet 68 of the wall panel 66 has been bent such that a first subportion 70 thereof has been bent over the wall panel edge and extends in parallel with the wall panel edge; a second subportion, adjacent to the first subportion and closer to the very edge of the outer sheet 68, has been further bent and extends rearwards in parallel with the outer sheet 68; and finally a third subportion 72, which includes the edge of the outer sheet 68, extends in parallel with the first subportion 70 towards the inner sheet 69. The inner sheet, in turn, has an extended edge portion 73, that has been bent over a portion of the edge of the wall panel 66, and which is aligned with the third subportion 72. There is a gap between the edges of the outer and inner sheets 68, 69. The cross section of the profiled bar 80 basically is rectangular, and has a width that corresponds with the distance between the second subportion 71 and the outer surface of the outer sheet 69, and a substantial depth that corresponds with the distance between the first subportion 70 and the third subortion 72. Additionally, it has a T-shaped rib 81 extending along the length of the bar 80 and protruding from a rear wall 82 thereof through said space and into the foam 67. Further, the bar comprises a lip 83 which extends along the bar 80 and also protrudes from the rear wall 82 thereof, but it is substantially L-shaped and has a main portion that extends in parallel with the rear wall 82 while defining a slot together with the rear wall 82. The edge portion 73 of the inner sheet 69 is received in the slot. The rib 81 and the lip 83 ensures that the bar 80 becomes properly attached to the wall panel 66. Like the above-described embodiment the profiled bar has two major chambers. One chamber 84 is closed and filled with foam, or air filled with sealed ends, as described above in conjunction with another embodiment, and the other chamber 85 is open but the opening is covered by a metal strip 86 acting as a lid of the chamber 85. In correspondence with the above embodiment the open chamber 85 accommodates a thermosiphon tube 87.

A further embodiment of the profiled bar 140 is similar to the profiled bar 23 described above with reference to FIG. 6. Thus, e.g. it has two chambers 142, 144, a U-shaped holder 146 for receiving the thermosiphon tube, and a first wing 148 at an inner side of the bar 140. However, for instance it differs in that it lacks the rib at the rear wall of the bar, and has an additional second wing 149 arranged opposite to the first wing 148 at an outer side of the bar. The second wing 149 is arranged to cover an edge portion of an outer surface, and thus of an outer sheet, of a panel, and simultaneously the transition between the outer sheet and the bar 140. This bar 140 has a planar rear surface, which is preferably adhesively attached to the edge surface of a panel.

Figure 22:
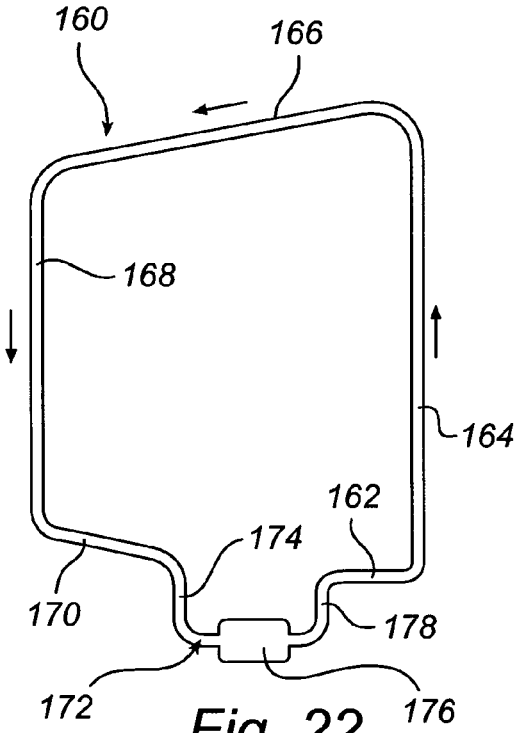
FIGS. 22 and 23 illustrate alternative embodiments of the thermosiphon.
Figure 23:
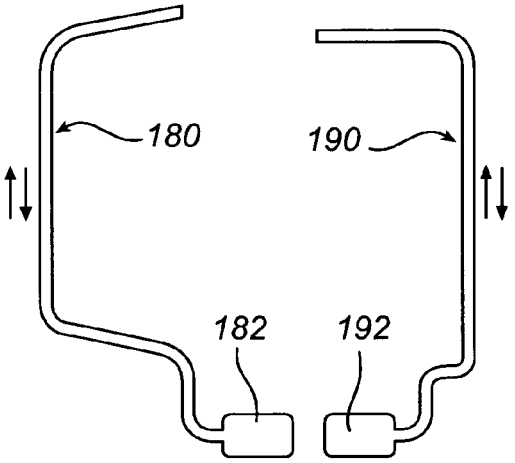

There are many alternative shapes of the condensation preventing device, or thermosiphon tube, and some are illustrated in FIGS. 22 and 23. Thus, as shown in FIG. 22, the condensation preventing device is constituted by a substantially rectangular heat carrier tube 160, which is arranged in a loop. It is arranged to be mounted in the front frame portion of a cabinet as has been described above. The loop comprises a bottom section 162, a first vertical section 164, a top section 166, a second vertical section 168, and an end section 170. It further comprises a boiler portion 172, which is connected between the end section 170 and the bottom section 162, and is located at a lowest point of the thermosiphon tube 160. In fact, the boiler portion has a first tube section 174 which is arranged to be mounted such that it extends downwards, and inwards of a cooling module placed below the cabinet. The very boiler 176, which is a widened section of the tube 160, i.e. having a larger cross-sectional area than the rest of the tube 160, and which follows after the first tube section 174, is placed in thermal contact with a heat source in the cooling module, as has been explained above. From the boiler 176 a second tube portion leads upwards and outwards to said bottom section 162. The top section 166 and the end section 170 are slightly inclined, by an angle of only one or a few degrees. The angle is most exaggerated in the figure, for purposes of illustration. In reality, these tube sections are arranged to keep within the thickness of the front edges of the top panel and bottom panel of the cabinet, respectively. The inclination has the purpose of guiding, in the right direction, the heat carrier fluid that has transformed from gaseous state to liquid state during the propagation through the tube 160.

According to other embodiments, as shown in FIG. 23, the condensation preventing device 180, 190 is arranged as a one-way tube having two closed ends. At one end a boiler portion 182, 192 is formed. As shown by the arrows in the figure, the gaseous heat carrier fluid 180, 190 raises up through the tube, condensates at an upper portion of the tube 180, 190, and returns back, in liquid state, to the boiler portion 182, 192 through the same tube 180, 190.

Figure 13:
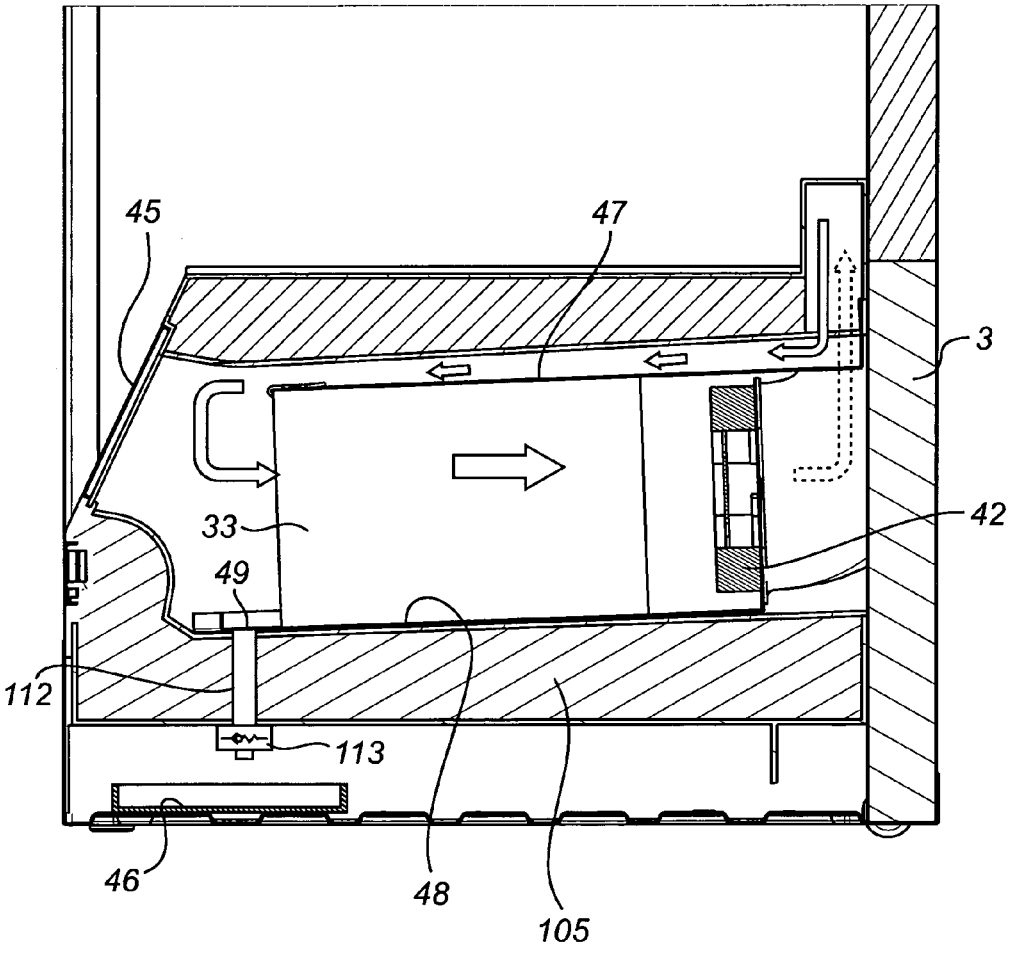
FIG. 13 is a cross section along F-F in FIG. 9 from the front side to the rear side of the cooling module mounted in the cold appliance of FIG. 1*a* and through the evaporator.
Figure 14:
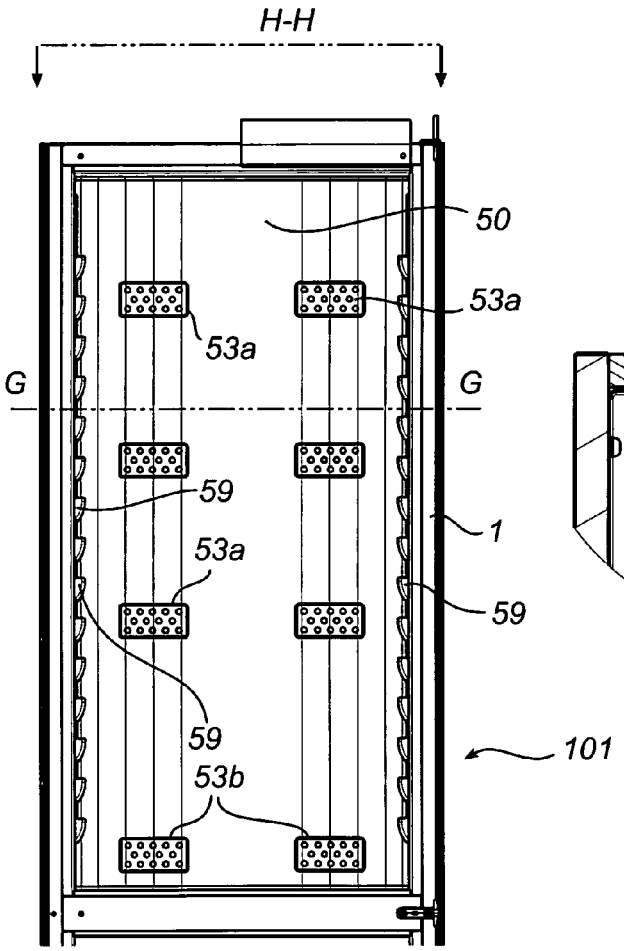
FIG. 14 is a view as seen from the cabinet opening of an inner wall positioned against the inside of the rear wall panel.
Figure 15:
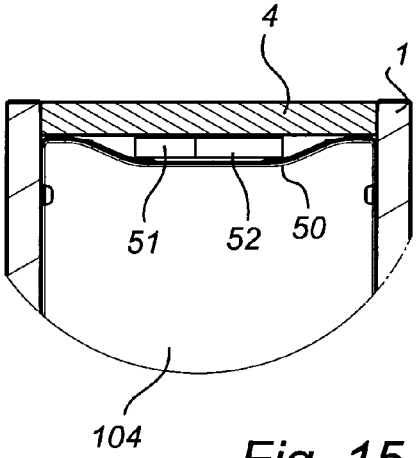
FIG. 15 is a cross section along G-G in FIG. 14 through the rear wall panel and the inner wall according to FIG. 14.

Reference is now made to FIGS. 8 to 13 as well as FIGS. 1*a* and 1*b* for a more detailed description of the cooling module 102, which is of a so called dynamic cooling type in which cold air is generated and then blown into the cold compartment 104 of the appliance 100 where the articles to be cooled are stored. By this design there is no need for any evaporator coils inside the cold compartment 104, which facilitates assembling of the cold appliance from modular units. The cooling module 102 is divided into a cold section 34 and a warm section 35, which are separated by a thermally insulating wall 105. The cold section 34 is substantially located on one half of the cooling module 102, while the warm section 35 is located adjacent to the cold section and also includes a lowest part of the cooling module 102, below the cold section 34. The cold section 34 holds, inter alia, an evaporator 33 and a first fan 42, which is mounted on a rear side of the evaporator 33, i.e. a side that faces the rear wall 4 of the cold appliance 100. Further, the cold section 34 accommodates an outlet air duct 43, which is connected with the fan, at a rear side thereof, and extends in a curved fashion debouching upwards, and an inlet air duct 44, which extends from the rear end of the cooling module 102, where it is arranged adjacent to the outlet air duct 43, to the front side of the evaporator 33. The first fan 42 generates an air flow through the evaporator 34, which cools the air, and out through the outlet air duct 43 to be forwarded into the cold compartment 104. Return air is flowing back from the cold compartment 104 to the evaporator 33 through the inlet air duct 44, and/or through an inlet opening 45 at the front end of the cooling module 102. It should be noted that in a cold appliance which is a freezer having a single compartment typically the front end inlet opening 45 is used, while in a cold appliance which has a refrigerator compartment and a freezer compartment typically the front inlet opening 45 is used by the freezer compartment and the inlet air duct 44 is used by the refrigerator compartment. Inter alia for air circulation matter, the cold appliance 100 is provided with a rear wall lining 50, as is shown in FIGS. 14 and 15. The rear wall lining 50 comprises a sheet, which is positioned on the inside of the rear wall panel 4 by means of e.g. snap fitting or gluing, and which is curved outwards, i.e. towards the front of the cold compartment 104, preferably in the middle, thereby forming a space between the rear wall lining 50 and the rear wall panel 4. In an alternative embodiment the rear wall lining is however planar, though arranged at a distance from the rear wall panel, thereby forming said space. The lining 50 comprises a cold air duct 51, a warm air duct 52, which ducts 51, 52 are arranged in the space, inlet air vent openings 53*a*, which are distributed across the lining 50 and communicates with the cold air duct 51, and outlet air vent openings 53*b*, which are positioned below the inlet air vent openings 53*a* at a lowest portion of the lining 50 and communicates with the warm air duct 52. In alternative embodiments the air vent openings 53*a*, 53*b* are differently arranged or are differently connected to the cold and warm air ducts 51, 52, respectively. The air ducts 51, 52 are hidden behind the sheet of the lining 50, in the space that is obtained between the outwardly curved portion thereof and the rear wall panel 4. The cold air duct 51 is engaged with the end of the outlet air duct 43, and the warm air duct 52 is engaged with the inlet air duct 44.

Thus, the air circulation is as follows. Cooled air flows from the evaporator 33, through the first fan 42, via the outlet air duct 43, the cold air duct 51 and the inlet air vent openings 53*a* into the space of the cold compartment 104. The air is distributed throughout the interior space of the cold compartment 104. Within the cold compartment 104 the interior parts, such as shelves (not shown for reasons of clarity), contributes to a substantial extent to the guidance and mixing of the air. Humidified and slightly warmed air is forced out of the cold compartment 104 through the outlet air vent openings 53*b*, via the warm air duct 52 and the inlet air duct 44 back to the evaporator 33. Optionally, the front inlet opening 45 is used for the humidified return air as well. However, primarily the front inlet opening 45 is used in case of a cold appliance having a refrigerator on top of and separated from a freezer, in which case the front inlet opening 45 guides air only from the freezer to the cooling module 102.

There are alternative solutions to the air circulation, including different arrangements of vent openings, differently formed lining or another solution to the air distribution within the cold compartment, different arrangement of air ducts in the cooling module, etc., as is understood by a person skilled in the art. Further, a part of the warmed up air that is ventilated from the cold compartment can be let out at the rear side of the cold appliance, in order to avoid condense at the back of the cold appliance. However, the herein described and illustrated embodiment is advantageous and presently preferred.

The rear wall lining 50 has further purposes in addition to providing opportunities for distributing cold air into as well as drawing warm air out of the cold compartment 104 through the air vent openings 53*a*, 53*b*. For instance, the rear wall lining 50 may have an aesthetic purpose. Since the rear wall panel 4 is manufactured by the manufacturing method of this invention, it can be difficult to vary the appearance of the inner surface and the rear wall lining can also be used to cover any defects which might arise especially in the inner corners of the cabinet 101 during assembling. The rear wall lining 50 can also be utilized for other kinds of installations such a lighting and control means or for hiding cabling used for such parts, and it can also be provided with supports for shelves inside the cabinet. In the illustrated embodiment shelf supports 59, which provides for a flexible positioning of the shelves, are arranged on the inner side walls of the cabinet 101.

The cooling module 102 further comprises a warm section 35, which inter alia holds a compressor 36, which is connected to an output of the evaporator 33, and a condenser tube 32, which is connected to an output of the compressor 36, as well as to an input of the evaporator, via a pressure lowering valve, as is common knowledge. The connections between the cold and the warm sections 34, 35 are made via properly sealed via-holes through the insulating wall 105. Further the warm section 35 holds a second fan 37, which is arranged at a front portion of the warm section 35, in front of the compressor 36.

The compact cooling module 102 sets tough requirements on the different solutions involved. One such solution is related to the condenser tube 32. Despite the limited space the condenser tube 32 has to be efficiently cooled. The condenser tube 32 has an extended length and is laid in windings, in one or more layers, over a metallic bottom plate 31 for enhanced cooling. The condenser tube 32 uses as large part of the area of the bottom plate 31 as possible, thereby, inter alia, partly extending beneath the cold section 34. This condenser tube—plate structure is advantageous, inter alia, in that no particular cooling flanges have to be used, and in that the overall area of the cooling structure becomes large relative to the volume occupied thereby. During operation, an air flow is drawn by means of the second fan 37 through an inlet opening 38 in the lower front portion of the cooling module 102, as is best seen in FIG. 1. The air flows from the inlet opening 38 over the bottom plate 31, around the compressor 36 towards the rear portion of the cooling module 102, and is guided by means of curved vertical fins 39, arranged at a rear part of the warm section 35, around a partition wall 40, such that the air flows in a direction forward and out through an outlet opening 41 arranged side by side with the inlet opening 38 in the lower front portion of the cooling module 102. These openings 38, 41 are arranged below the door 6 of the cold appliance 100. The partition wall 40 runs rearwards from the front wall 106 of the cooling module 102, between the inlet and outlet openings 38, 41, over a distance, but leaves an opening for air passage into the fins 39.

As is apparent from the drawings, and as described above, the cooling module 102 is well insulated around the evaporator 33 and towards the cold compartment 104 in order to restrict thermal transmission between the warm section 35 of the cooling module 102 and the cold section 34 and the cold compartment 104, respectively.

In a cold appliance where the cooling effect is generated by a cooling module according to the herein described and illustrated self-contained type, and is distributed by an air flow inside the cabinet, it is a desire to make the cooling module compact. In the illustrated embodiment this results in that at least a part of the evaporator 33 is positioned lower than an upper portion of the compressor 36. This has some negative impact on the defrost system, i.e. the system which effects warming of the evaporator 33 for melting of frost and ice aggregated thereon, drainage of the resulting defrost water, and evaporation of the defrost water. Normally the defrost water is evaporated from a basin on top of the compressor as the warm compressor casing is heating up the water. The water is led by gravity from the evaporator to the basin by a tube or the like. However, when the evaporator, at least partly, is positioned lower than the compressor, this is not a possible solution. To solve this problem in the present embodiment, the condenser is structured as a condenser plate, which is also a bottom plate, 31 of metal having a length of the condenser tube, i.e. a refrigerant conduit, 32 laid in windings on the condenser plate 31 for cooling purposes, as is illustrated in FIG. 10. In this way it is possible to let the defrosted drain water flow out onto the condenser plate 31 or, as in this embodiment, onto a drain water tray 46 positioned on top of the condenser tube 32. This will lead to an increased cooling effect of the condenser plate at the same time as the drain water is evaporated.

In a cooling module according to a self-contained type, as described and illustrated herein, the cooling is accomplished by dynamic cooling by which cool air is circulated in the cold appliance to cool the articles which are stored in the cold compartment. The air is cooled by passing through the evaporator 33 and the first fan 42 is used to draw the air through the evaporator 33. For the purpose of increasing the cooling capacity of the cooling module 102, the form or shape of the evaporator 33 and the first fan 42 is adapted to each other. In the illustrated embodiment, the evaporator 33 has a substantially quadratic cross sectional shape perpendicular to the air flow, with a maximum cross-sectional dimension which is only slightly larger than the diameter of the fan. This is best seen from FIGS. 11 to 13. In this way the dimensions of the evaporator 33 and the fan 42 will be advantageously adapted to each other such that the air flow will be substantially uniformly distributed over the evaporator cross section. Hence, the evaporator 33 will be utilized in an optimal way. Naturally, an evaporator having a circular cross sectional form would be the most optimal, and is an alternative embodiment, but that would probably lead to a more expensive evaporator. However, it should be understood that the evaporator could be slightly rectangular as well. Generally it is considered that the maximum width or height dimension of the evaporator should be less than 20% larger than the diameter of the fan and preferably less than 10% larger than the diameter of the fan. An effectively operating evaporator has to result that its overall dimensions can be reduced, which always is an advantage and especially for a cooling module as in this embodiment.

A domestic cold appliance of the dynamic cooling type, as in this embodiment, is normally causing a considerable amount of frost and ice on the surface of the fins of the evaporator 33. The return airflow from the cold compartment, in particular the cold compartment of a refrigerator, is relatively warm and humid and when this air is brought to the cold evaporator the humidity is forming frost and ice on the evaporator. To avoid or at least reduce this problem, a pre-defroster plate 47 is arranged above the evaporator 33 in contact with it, as is illustrated in FIG. 13. The pre-defroster plate forms a bottom of the inlet air duct 44. The relatively warm and humid return airflow from the cold compartment is conveyed on the other side of the pre-defroster plate 47 in relation to the evaporator 33, i.e. on the upper side. This has to effect that at least a large part of the humidity content of the air flow will condense and freeze on the pre-defroster plate before it reaches the evaporator 33 with decreased risk that the air flow through the evaporator 33 will be blocked due to frost deposit within the fin spacing of the evaporator 33. Additionally, it is possible to arrange the fins closer to each other, i.e. the spacing are narrower, than without the pre-defroster plate 47 without risking frost clogging of the spacing. This, in turn, results in a smaller evaporator. As is apparent from FIG. 13, the evaporator 33 as well as the pre-defroster plate 47 is inclined downwards towards the front end of the cooling module 102. When the evaporator 33 is heated for defrosting, which normally is effected automatically with suitable intervals and which is typically accomplished by electrical heating, the defrost water from the pre-defroster plate will flow forward and down onto a defrost water collecting plate 48, which also is visible in FIG. 11, together with the defrost water from within the evaporator. The collecting plate 48 is located slightly inclined forward immediately below the evaporator 33 and is provided with a low rim along its edges and a hole 49 connected to a draining pipe 112 in its forward end. Through the draining pipe 112, the defrost water will flow down onto the drain water tray 46, as mentioned earlier, positioned on the condenser plate 31, such that the defrost water can evaporate by means of the heat from the condenser tube 32. In order to ascertain that warm air from the warm section is not entering the cold section up through the draining pipe 112, it is provided with a non-return valve 113 most schematically illustrated in FIG. 13.

Figure 24:
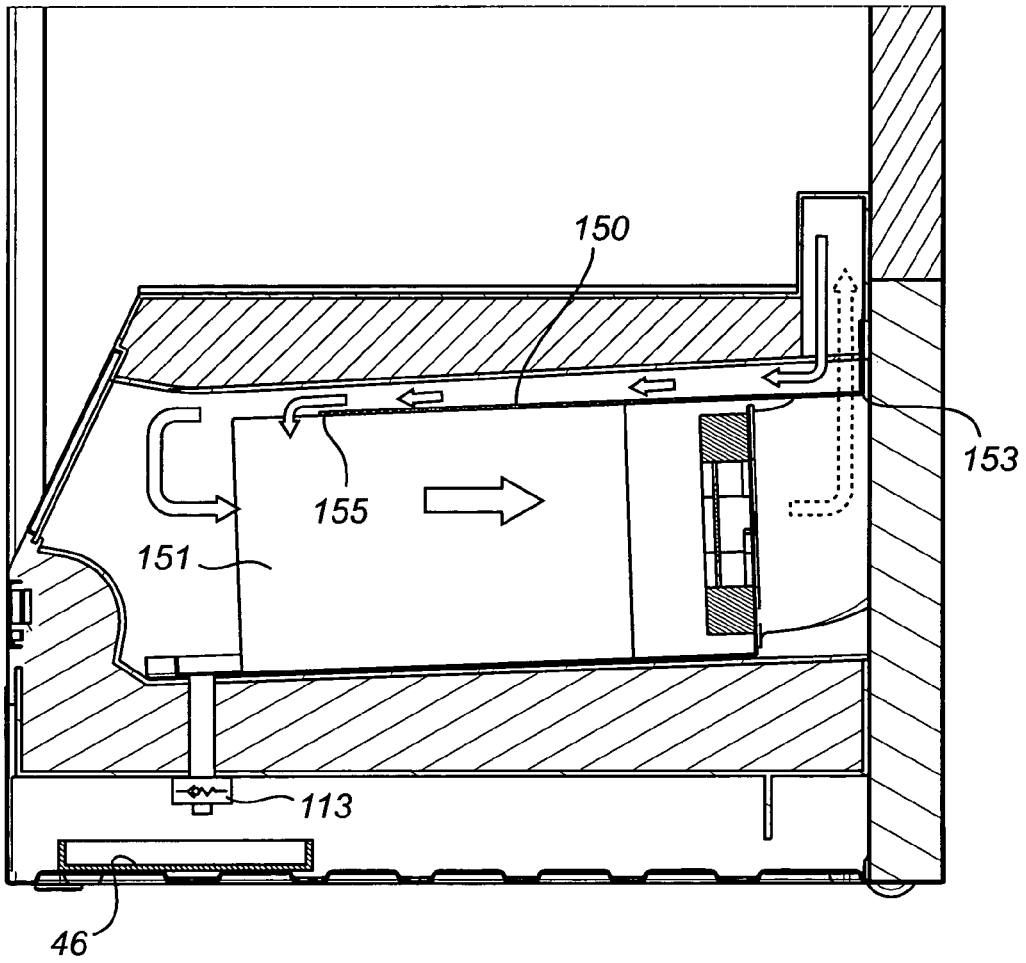
FIG. 24 is a cross-sectional view along F-F in FIG. 9 of an alternative embodiment of the cooling module.

In accordance with an alternative embodiment of the cooling module, as shown in FIG. 24, the pre-defrost defrost device 150 comprises a first end 153 and a second end 155, wherein the air from the cold compartment passes the first end 153 before the second end 155, and wherein the first end is located at a distance from the main inlet to the evaporator 151. In other words, the pre-defrost device 150 covers a major part of the top surface of the evaporator 151 but not the whole top surface like the first-mentioned embodiment of the pre-defrost device. Thereby, the air is allowed to, after passing the pre-defrost device 150, enter the evaporator structure from the top thereof in addition to the front end thereof.

During defrosting of the evaporator 33, the heat leakage into the cold compartment 104 would normally be considerable due to air circulations in the air ducts 43, 44. With the evaporator in the very low position in the cabinet, as in this embodiment, this risk is even more evident due to natural convection of the air. One way to restrict this heat leakage is to provide air shutters in the air ducts, which will close the air ducts during the defrost periods. A drawback with such a solution is that it necessitates the provision of more movable parts as well as control equipment, which of course will increase the costs for the cooling module. Another drawback is a fall of pressure across the air shutters also when fully open. However, the cooling module according to the present embodiment will prevent, to a large extent, such heat leakage without any need for air shutters or the like. The reason for this will be explained below.

Before the defrost period the air circulation in the evaporator and cold compartment is slowed down by stopping the fan 42. When the fan is stopped the air will, after a short time, essentially stop circulating. The air movements in the cabinet will be few and small. When the defrost period start the evaporator is heated to melt ice and snow in and on the evaporator, and if there is a pre-defrost device also melt snow and ice on that one. The air inside and close to the evaporator will also be heated, and heated air expands and raises since it is lighter than colder air. This will start a movement of hot air from the evaporator to the cold compartment. If to much warm air enters the cold compartment the temperature raises and eventually this could damage the goods inside.

In order not to raise the temperature in the cold compartment to much the evaporator 33 is kept in a restricted and well insulated space with relatively small inlet and outlet openings and corresponding air ducts 43, 44. The amount of air in this restricted space is therefore quite small. During use the temperature in the evaporator is lower than the lowest temperature in the cold compartment. The movement of the air into the cold compartment is mainly passing the outlet and the air duct 43. The air duct 43 has a relatively small cross section, the air duct has a smaller cross section compared to the cross section of the evaporator, and also small openings into the cold compartment, the cross section of at least one opening into the cold compartment is smaller than the cross section of the air duct 43. Since the air has been stable for some time there have been layers of air with different temperature in the ducts, layers which are quite stable. During the beginning of the defrosting period the temperature in the evaporator and the lower part of the air duct 43 will be lower than the temperature in the cold compartment. This cold air is heavier than the air in the cold compartment and will act as a lid. When the small amount of heated air from the evaporator tries to raise in the air duct the layers will prevent air circulation upwards. This effect is also enhanced due to the small openings into the cold cabinet.

The fan could also be used to help preventing air movements up in the air ducts, since it is possible to use the fan to stabilize the airflow during defrosting. This is done by using the fan to minimize the amount of hot air leaving the cooling module or distributing hot air in a controlled way so that it is mixed with the cool air in the compartment in such a way that the temperature in the cold compartment is not raising to a level affecting the goods inside the compartment. The use of the fan could also be used in combination with shutters in the air ducts.

More particularly, according to the present invention there is provided a cold appliance comprising a cooling module, and a cabinet, which comprises a cold compartment, wherein the cooling module is arranged at the bottom of the cold appliance, wherein the cooling module comprises a cold section and a warm section, which is separated from the cold section by an insulating wall, an evaporator arranged in the cold section, and a compressor and a condenser arranged in the warm section, and wherein the cooling module comprises an air outlet for supplying cool air from the cold section to the cold compartment and an air inlet receiving air from the cold compartment to the cold section. The cold appliance is characterised in that the air outlet comprises an air duct having at least on opening into the cold compartment, said air duct extending essentially in a vertical direction and are arranged in such a way that cold air in the air duct provides a temperature layer of air which prevents entrance of heated air into the cold compartment during a period of defrosting of the evaporator.

According to a further embodiment the air in the air duct has a lower temperature than the air in the evaporator during defrosting.

According to a further embodiment, the air duct comprises at least one, preferably 3 or more, openings arranged at different heights in the cold compartment.

According to a further embodiment the air duct has a smaller cross section compared to the cross section of the evaporator.

According to a further embodiment the cross section of at least one opening into the cold compartment is smaller than the cross section of the air duct.

According to a further embodiment the cooling module comprises a fan for circulating the air through the evaporator, and cold compartment, and during defrosting of the evaporator the fan stabilises the air in the cooling module and the cold compartment such that the air circulation between the cooling module and the cold compartment is low.

The cold appliance can allow manufacturing of a cold appliance as a modular system, which is manufactured in separate modular units, to allow transporting the modular units in a cost effective, space saving way, and to allow assembling of the modular units in an uncomplicated way into a complete cold appliance near the place of use.

Thus, there is provided a cold appliance construction kit comprising a cooling module, a plurality of cabinet panels, including wall panels, to be assembled into a cabinet, and at least one door. Each cabinet panel comprises an inner sheet, an outer sheet and an intermediary layer of a foamed insulating material. Each cabinet panel has an inner surface, an outer surface, and four edge surfaces. At least one of the edge surfaces of at least a first wall panel of the wall panels is formed such that at least one of said outer and inner sheets comprises an edge portion that extends beyond the edge surface of the foamed insulating material and provides an attachment area for attachment to another cabinet panel.

Further, there is provided a cabinet for a cold appliance, which cabinet has been assembled from separate cabinet panels comprising two opposite side wall panels, a rear wall panel, a top panel, and a bottom panel, which are connected essentially perpendicular to each other by means of joints. At least the side wall panels and the rear wall panel each have an inner surface, an outer surface and four edge surfaces, and comprise an inner sheet defining the inner surface, an outer sheet defining the outer surface and an intermediary layer of a foamed insulating material. At least one of the joints between the side wall panels and the rear wall panel is designed such that at least one of the inner sheet and the outer sheet of at least a first wall panel of the wall panels involved in the joint has an edge portion that extends beyond the edge surface of foamed material and provides an attachment area at which a second wall panel involved in the joint is attached.

By means of the construction kit and cabinet, respectively, a joint which is inexpensive and easy to perform, gives stability to the cabinet, is air and moisture tight, is well insulated and presents an aesthetic pleasant appearance is obtainable.

Accordingly, by arranging an edge portion of the outer sheet of the wall panel such that is extends beyond the edge surface of the panel. In this way the extended outer sheet can optionally be bent over the edge surface, to wholly or partially cover the edge surface of the wall panel, or maintained projecting from the edge surface to utilize it as an overlapping portion. In both cases the edge portion provides the attachment area.

In accordance with embodiments of the cold appliance construction kit and the cabinet, the edge portion extends at an angle to the rest of the sheet and covers, at least partly, the edge surface of the foamed insulating material. For example, one of the wall panels involved in the joint has its outer sheet bent over the edge surface while the outer sheet of the other wall panel is projecting such that the projecting sheet is overlapping the bent over sheet.

In accordance with embodiments of the cold appliance kit and the cabinet, at least a part of an engagement area between the two wall panels at the joint is lacking any inner or outer sheet such that the wall panels are connected foam to foam in this part in order to prevent any thermal bridge between the interior of the cabinet and the ambient air.

In accordance with embodiments of the cold appliance kit and the cabinet, the outer sheet of both the first and the second wall panel at a joint, adjacent to each respective edge portion, is provided with an elongated groove formed of the outer sheet being curve shaped into the foam material, and wherein the cabinet further comprises a connection strip, which comprises two parallel longitudinal rib portions, which have been inserted into one groove each for connecting the two wall panels together.

The grooves are adapted to receive the respective elongated rib of the connection strip, preferably of plastics, which is placed over the joint between the wall panels and attached by means of for example gluing, snap fit attachment, screwing or a combination of these. The strip enhances the strength of the joint and is useful for fixing the two panels close to each other when they are being adhesively joined.

The cold appliance can relate to the above-mentioned problem associated with the condensation preventing device, and provide a cold appliance having an easily mountable condensation preventing device.

Thus, there is provided a cold appliance, such as a household refrigerator or freezer, comprising a cooling module, a cabinet, which cabinet has been assembled from separate cabinet panels comprising two opposite side wall panels, a rear wall panel, a top part, and a bottom part, which are connected essentially perpendicular to each other e.g. by means of joints and/or glue, a door, and a condensation preventing device including a heat carrier tube being positioned at a front frame portion of the cabinet of the cold appliance, preferably adjacent to a part of the door. The heat carrier tube is filled with a heat carrier fluid and is closed and has a boiler portion, which is arranged in thermal contact with a heat generating means of said cooling module for boiling the heat carrier fluid.

By providing the condensation preventing device as an independent unit, which is not interconnected with the cooling system of the cold appliance but has its own boiling portion that is merely arranged in thermal contact with a heat generating means of the cooling module, it is easy to assemble the cold appliance as a whole and to mount the heat carrier tube. Additionally, these features can make the mounting of the condensation preventing device more or less independent of the mounting of the cooling module. It is to be noted that the heat generating means can be, for example, a compressor, a condenser or a condenser plate of the cooling module. For instance, the heat carrier tube can be formed from different materials although a metal is preferred to achieve good thermal conductivity.

In accordance with an embodiment of the cold appliance, the heat carrier tube is closed in a loop. Then the heat carrier medium is able to circulate within the tube without contact with other corresponding medium of devices of the cold appliance.

In accordance with an embodiment of the cold appliance, the heat carrier tube is a one-way tube, which has two closed ends. This embodiment provides for even more simple solutions of the condensation prevention.

In accordance with an embodiment of the cold appliance, the cabinet comprises a profiled bar, which is mounted at the front frame portion e.g. at the front edge surfaces of the cabinet panels, and which is provided with support means for receiving the heat carrier tube. By providing the profiled bar, and by providing the profiled bar with the support means for receiving the heat carrier tube, the mounting of the heat carrier tube is further enhanced.

In accordance with an embodiment of the cold appliance, the heat carrier tube is snap-in connected to the support means, which underlines the easiness of mounting. However, also other ways of attachment could be conceivable, such as gluing or clamping.

In accordance with an embodiment of the cold appliance, the support means are arranged in a recess of the profiled bar, which ascertains that no excessive room is used by the heat carrier tube between the front frame portion and the door. Alternatively, the at least one side wall panel is provided with a recess for receiving the heat carrier tube.

In accordance with an embodiment of the cold appliance, when the heat carrier tube is mounted in the support means, it is covered by an elongate cover member, preferably of a metal for good thermal conductivity. Preferably the cover member is mounted with its inner surface in abutment with or at least close to the tube and the outer surface of the cover member is part of the surface of the front frame portion of the cabinet.

In accordance with an embodiment of the cold appliance there is provided a condensation preventing device comprising a heat carrier tube having a boiler portion, said heat carrier tube being filled with a heat carrier fluid and being closed. The condensation preventing device is arranged to be mounted in the front frame portion of a cabinet made of pre-foamed side wall panels, a rear wall panel, a top part and a bottom part.

In accordance with embodiments of the condensation preventing device, the heat carrier tube is closed in a loop, preferably in the shape of a rectangle. The loop comprises a bottom section, a first vertical section, a top section, a second vertical section, and an end section. The top section is inclined and/or the end section is inclined. Thereby a self-circulation of the heat carrier fluid within the tube is obtainable, where the inclined section/sections enhance(s) the return circulation of liquid state heat carrier fluid.

The cold appliance can provide an interface between the cabinet and the door, which interface is capable of providing the desired functions.

Thus, there is provided a cold appliance comprising a cooling module;

a cabinet comprising two opposite side wall panels, a rear wall panel, a top part, and a bottom part, and a door. Each panel comprises an inner sheet, an outer sheet and an intermediary layer of a foamed insulating material. Each cabinet panel has an inner surface, an outer surface, and four edge surfaces. The side wall panels, the rear wall panel, the top part, and the bottom part are assembled to form a cold compartment, which is closable with the door. The cold appliance further comprises a profiled bar, which is mounted at an edge surface of at least one of the panels. Preferably, the bar is mounted at the edge surfaces of a front frame portion of the cabinet.

Thus, a separate interface constituted by the profiled bar is provided. The profiled bar is manufactured separate from the cabinet panels and can be provided with different desired functions.

In accordance with an embodiment of the cold appliance, the profiled bar is made of a material, preferably a plastic material, reducing the thermal bridge between the inner surface and the outer surface of the panels during use of the cold appliance. Consequently, an appropriate choice of material improves the properties of the cold appliance, in particular when the outer and inner panel surfaces are made of metal.

In accordance with an embodiment of the cold appliance the profiled bar is attached to the edge of the panel by glue, e.g. double sided tape, which facilitates the mounting of the bar.

In accordance with an embodiment of the cold appliance the profiled bar is in abutment with the door when the door is closed, and it is provided with support means for receiving a condensation preventing device. By means of this integration of support means for the condensation preventing device in the profiled bar, the mounting thereof is simple.

In accordance with an embodiment of the cold appliance, the support means comprises a recess in which a heat carrier tube included in the condensation preventing device is received, and a cover member covering the recess. Thereby a smooth front surface is obtainable.

In accordance with an embodiment of the cold appliance, the cover member is made of a first magnetic material, and the door comprises a strip of complementary second magnetic material. Thereby the cover member and the strip in cooperation form a magnetic lock reliably keeping the door closed. In accordance with an embodiment of the cold appliance, the profiled bar provides additional functionality by having a first chamber extending along the length thereof, and a second chamber extending in parallel with the first chamber, wherein the first chamber holds the support means and is covered by the cover member, and wherein the second chamber is located closer to the interior of the cabinet than the first chamber. The second chamber can be closed and filled with an insulating material, such as air or foam.

In accordance with an embodiment of the cold appliance, the bar comprises a wing extending over an edge portion of the outer surface of a panel. This wing thus covers an outer corner, and an edge portion of the panel, which facilitates cleaning of the cold appliance and increases the appearence thereof. Additionally, it protects the insulating material.

The cold appliance can provide a cold appliance wherein the problem of the shape of the evaporator has been alleviated.

Thus, there is provided a cold appliance, such as a domestic refrigerator or freezer, comprising a cabinet having a cold compartment and a cooling module. The cooling module comprises an air outlet delivering cooled air to the cold compartment, an air inlet receiving air from the cold compartment, an evaporator, and an evaporator fan, which generates an air flow from the air inlet, through the evaporator, and to the air outlet. The cross-sectional shape of the evaporator is adapted to the airflow such that the rate of the highest air velocity to the lowest air velocity through different portions of the evaporator is minimized.

In accordance with an embodiment of the cold appliance, the cross-section of the evaporator is most preferably square, while a rectangular shape where a difference in length of the sides less than 20% works well. This is the best approximation of the shape of the cross-section swept by the evaporator fan that is available without causing excessive costs. On the other hand, according to another embodiment the cross-section of the evaporator is circular, which however adds to the costs.

In accordance with an embodiment of the cold appliance, the width of the evaporator advantageously corresponds to or is less than the cross-section swept by the evaporator fan.

In accordance with an embodiment of the cold appliance, the evaporator comprises a plurality of fin plates. The fin plates substantially increases the efficiency of the evaporator. By arranging a pre-defrost device adjacent to the evaporator, such that the air from the cold compartment is guided by the pre-defrost device before reaching the evaporator such that at least some humidity in the air from the cold compartment sticks to the pre-defrost device, several advantages are achieved. For instance, it takes longer time before the evaporator is clogged with frost/ice or the fins can be placed closer to each other without causing any shortage of the time between defrosting operations. By providing a larger number of fins, the efficiency is further raised.

It is possible to provide an automated manufacturing process for manufacturing the cabinet panels.

Thus, there is provided a method of manufacturing panels for a cold appliance, such as a household refrigerator or freezer, comprising two side wall panels, a rear wall panel, a top part and a bottom part attached together to form a cabinet, wherein each panel comprises an inner sheet, an outer sheet and an intermediary layer of foamed insulating material. The manufacturing of the panels comprises a continuous double belt foaming process and the steps of:

- feeding an upper and a lower sheet from respective upper and lower sheet rollers at an inlet end of a sheet forming and foam application machine;
- holding the upper and lower sheets at a distance from each other while feeding them from the inlet end towards an outlet end of the machine;
- profiling each sheet, if desired, to a profile shape,
- dispensing thermally insulating foam over the lower sheet surface in the space between the sheets;
- curing the foam, thereby obtaining a continuous sandwich web;
- cutting the sandwich web into cabinet panels, and
- controlling the cooling of the panels, such that the panel does not buckle.

By means of the method it is possible to manufacture panels as a continuous process.

In accordance with an embodiment of the method the step of profiling comprises bending an edge portion of at least one of the sheets relative to the rest of the sheet. Thereby different edge structures of the panels are obtainable for reasons of, for instance, panel assembling or reinforcement.

In accordance with an embodiment of the method further comprises at least one of:

- pre-machining the sheets, before the step of dispensing, to prepare them for subsequent mounting of separate parts; and
- providing the sheets, before the step of dispensing, with fastening details.

This embodiment is advantageous in that details arranged on or protruding into the inside of the sheets will be embedded in the foam subsequently applied.

According to another aspect, there is provided a method of manufacturfing a cold appliance, such as a household refrigerator or freezer, comprising panels manufactured according to the method of manufacturing panels for a cold appliance, comprising the steps of assembling a cabinet, and attaching a cooling module to the cabinet, wherein the step of assembling a cabinet comprises the steps of:

- connecting the two side wall panels and the rear wall panel with glue along most of the length of the edge of the rear wall panel or the side wall panel; and
- connecting a top part and a bottom part to the side walls and rear wall.

The cold appliance can provide a cold appliance alleviating the above-mentioned problem which arises when the evaporator is at least partly arranged below the compressor.

Thus, there is provided cold appliance comprising a cooling module, and a cabinet, which comprises a cold compartment, wherein the cooling module comprises an air outlet delivering cooled air to the cold compartment, and an air inlet receiving air from the cold compartment. The cooling module is arranged at the bottom of the cold appliance, and it comprises a cold section, a warm section, which is separated from the cold section by an insulating wall, an evaporator arranged in the cold section, and a compressor and a condenser arranged in the warm section. The condenser comprises a condenser tube, which is arranged in windings on, or is integrated with, a bottom plate of the cooling module.

Thereby a heat generating device, i.e. the condenser tube, is available at a bottom level of the cooling module, which is usable for purposes of evaporating the defrost water.

In accordance with an embodiment of the cold appliance the cooling module comprises a drain water tray, which is arranged adjacent to the condenser tube, and which receives defrost water from the evaporator. This is an advantageous way to use the heat generated by the condenser tube for evaporating the defrost water, in combination with cooling the condenser tube efficiently.

In accordance with an embodiment of the cold appliance the drain water tray is constituted by a portion of the bottom plate. This is a simple realization of the drain water tray, where the basic structure of the cooling module is employed.

On the other hand, in accordance with an embodiment of the cold appliance, the drain water tray is constituted by a separate tray arranged on top of the condenser tube.

In accordance with an embodiment of the cold appliance the cooling module further comprises a defrost water collecting plate arranged below the evaporator, and a draining pipe extending from the defrost water collecting plate to the drain water tray, and guiding the defrost water to the drain water tray. Thereby the defrost water is safely collected and transported between the cold section to the warm section with a minimal impact on the thermal partitioning between the sections.

In accordance with an embodiment of the cold appliance the condenser tube is arranged inside the drain water tray, whereby its heat is effectively transferred to the water.

The cold appliance can provide a solution to post-mounting of parts, such as cables and air ducts, properly within the cold appliance.

Thus, there is provided a cold appliance comprising a cooling module; a cabinet comprising cabinet panels including two opposite pre-foamed side wall panels, a pre-foamed rear wall panel, a top part, and a bottom part; and a door. The cooling module comprises an air outlet delivering cooled air to the cold compartment, and an air inlet receiving air from the cold compartment. The cold appliance further comprises a rear wall lining, which is arranged at the inside of the pre-foamed rear wall panel, and which forms a space between the rear wall lining and the rear wall panel.

The lining is realisable as a separate part that is easy to mount, and many post-mounted parts can be hidden in the space between the rear wall lining and the rear wall panel.

In accordance with an embodiment of the cold appliance, the rear wall lining comprises an inlet air duct connected with said air outlet, and an outlet air duct connected with said air inlet, which ducts are arranged in said space, first air vent openings connected with said inlet air duct and with the cold compartment, and second vent openings connected with said outlet air duct and with the cold compartment. Thereby the rear wall lining is useful for arranging the air circulation within the cold compartment in a desired way.

In accordance with an embodiment of the cold appliance the rear wall lining is used for hiding cables running in the space. Thus, an additional functionality of the lining is provided. That is the case for another embodiment as well, where the cold appliance further comprises electric elements mounted at the rear wall lining. Such elements are for instance a fan, lighting, a temperature sensor, and a motor.

In accordance with an embodiment of the cold appliance, it further comprises shelf supports arranged on the rear wall lining.

In accordance with an embodiment of the cold appliance, the rear wall lining is attached to the rear wall by mechanical means, e.g. press fitting or snap fitting. This solution provides a fast and simple attachment.

The cold appliance can provide a device for increasing the thermal as well as the cost efficiency of an evaporator and to avoid or at least reduce the forming of frost and ice on the evaporator.

Thus, there is provided a cold appliance, such as a refrigerator or a freezer, comprising a cabinet having a cold compartment and a cooling module, wherein the cooling module comprises an air outlet delivering cooled air to the cold compartment, an air inlet receiving air from the cold compartment, an evaporator, and an evaporator fan, which generates an air flow from the air inlet, through the evaporator, and out of the air outlet. The cooling module further comprises a pre-defrost device, which is arranged adjacent to the evaporator, such that the air from the cold compartment is guided by the pre-defrost device before reaching the evaporator, such that at least some humidity in the air sticks to the pre-defroster device.

Accordingly, by arranging a pre-defrost device, which is in contact with or close to the evaporator and/or the cold airflow from the evaporator, letting the return airflow from the cold compartment pass the pre-defrost device, at least a part of the humidity contained in the airflow will condensate and freeze on the pre-defrost device before it reaches the evaporator.

In accordance with an embodiment of the cold appliance, the pre-defroster device is arranged in thermal contact with the evaporator such that when the evaporator is heated for defrosting the pre-defrost device also is defrosted. Consequently, no separate defrosting of the pre-defrost device is necessary.

In accordance with an embodiment of the cold appliance, the pre-defrost device includes a plate, and is positioned on top of the evaporator. Thereby it forms a lower wall defining an air duct for the return airflow. However, the pre-defroster member could also have many other shapes, e.g. as a circular or square tube surrounding the evaporator and/or the cold airflow from the evaporator, such that the warm and humid return airflow is brought to flow on the outside around the tube before entering the evaporator.

In accordance with an embodiment of the cold appliance air is admitted to pass through the pre-defrost device, e.g. by arranging it with spaced flanges, or by making it of a porous material.

In accordance with an embodiment of the cold appliance the pre-defrost device comprises a first end and a second end, the air from the cold compartment passes the first end before the second end, and the first end is located at a distance from the main inlet to the evaporator. This means that air is admitted to freely contact an upper portion of the evaporator, or passing through a portion of the evaporator from above in addition to entering the evaporator from the main inlet end.

In accordance with an embodiment of the cold appliance the distance between fin plates in the evaporator is between 2-10 mm, and preferably between 3-5 mm. These distances are rather small compared to what would be appropriate if the pre-defrost device would not have been provided.

The cold appliance can provide a cabinet design that has a good stability and strength although it has been assembled from separate parts.

Thus, there is provided a cold appliance, such as a household refrigerator or freezer, comprising a cabinet and a cooling module, which cabinet comprises cabinet panels including two opposite side wall panels, a rear wall panel, and a top part, which are connected essentially perpendicular to each other by means of mechanical and/or glue joints. Each cabinet panel comprises an inner sheet, an outer sheet and an intermediary layer of a foamed insulating material, wherein each cabinet panel has an inner surface, an outer surface, and four edge surfaces. The cooling module comprises a cold section and a warm section, which is separated from the cold section by an insulating wall, an evaporator arranged in the cold section, and a compressor and a condenser arranged in the warm section. The cooling module comprises a bottom part comprising support means, such as wheels and/or feet, and the bottom edge surface of at least one of the side wall panels is attached to the bottom part.

In accordance with an embodiment of the cold appliance, each one of the side wall panels are glued together with the rear wall panel over a major part of the vertical edge surface of the side wall panel or the rear wall panel. The glue joints thus having a significant area, distribute the tensions generated in the cabinet by the thermal loads occurring during use of the cold appliance.

In accordance with embodiments of the cold appliance, each joint between one of the side wall panels and the rear wall panel comprises a vertical elongated groove formed at one of the side wall panel and the rear wall panel, and a connection strip arranged at the other and inserted into the groove such that the vertical edge surface of the side wall panel or the rear wall panel is pressed against the inner surface of the rear wall panel or the inner surface of the side wall panel. The groove—strip connection further strengthens the joints.

In accordance with an embodiment of the cold appliance, a reinforcing fitting is attached in the front corner between the side wall panel and the top part for e.g. attachment of a door hinge.

In accordance with an embodiment of the cold appliance, at least one of the pre-foamed side wall panels is manufactured by means of a method which comprises a continuous double belt foaming process, preferably also the rear wall panel.

In the drawings and specification, there have been disclosed preferred embodiments and examples of the invention. Features and details described in the different embodiments and examples are not limited to be used in that specific embodiment or example unless explicitly so stated. If not stated otherwise, features in one embodiment or example can therefore be used in another embodiment or example. It will also be evident to the person skilled in the art that several modifications are conceivable without departing from the invention as defined by the following claims.

The invention claimed is:

1. A cold appliance comprising a cooling module (102), and a cabinet (101), which comprises a cold compartment (104), wherein the cooling module comprises an air outlet (43) delivering cooled air to the cold compartment, and an air inlet (44) receiving air from the cold compartment, wherein the cooling module is arranged at the bottom of the cold appliance, and wherein the cooling module comprises a cold section (34), a warm section (35), which is separated from the cold section by an insulating wall (105), an evaporator (33) arranged in the cold section, and a compressor (36) and a condenser (32) arranged in the warm section, characterized in that the condenser comprises a condenser tube (32) including condenser tube windings integrated in a bottom plate (31) of the cooling module that extend horizontally, wherein the cooling module further comprises an inlet opening (38), an outlet opening (41), a partition wall (40), and a fan (37) configured to draw air through the inlet opening (38) and over the bottom plate (31) and expel the air out of the outlet opening (41), wherein the partition wall (40) is arranged such that air passing from the inlet opening (38) to the outlet opening (41) travels from the inlet opening (38) in a first direction, around the partition wall (40), and then toward the outlet opening (41) in a second direction that is opposite the first direction, and wherein the cooling module further comprises at least one curved fin arranged to guide air passing from the inlet opening (38) to the outlet opening (41) around the partition wall (40).

2. The cold appliance according to claim 1, wherein the cooling module (102) comprises a drain water tray (46), which is arranged adjacent to the condenser tube (32), for receiving defrost water from the evaporator (33).

3. The appliance according to claim 2, wherein the drain water tray (46) is constituted by a portion of the bottom plate (31).

4. The cold appliance according to claim 2, wherein the drain water tray (46) is constituted by a separate tray mounted to be in direct contact with the top of the condenser tube (32).

5. The cold appliance according to claim 2, wherein the condenser tube (32) is arranged inside the drain water tray (46).

6. The cold appliance according to claim 2, wherein the cooling module (102) further comprises a defrost water collecting device (48) arranged below the evaporator (33), and a draining pipe (49) extending from the defrost water collecting plate to the drain water tray (46), and guiding the defrost water to the drain water tray.

7. The cold appliance according to claim 6, wherein the defrost water collecting device (48) comprises a plate or a tray on or in which the evaporator (33) is arranged.

8. The cold appliance according to claim 1, wherein the cabinet (101) comprises two side wall panels (1) and a rear wall panel (4), and wherein at least one of the side wall panels, preferably the side wall panel which partly encloses the cold section (34) of the cooling module (102), is attached to the bottom plate (31).

9. The cold appliance according to claim 8, wherein at least one of the side wall panels (1) or the rear wall panel (4) comprises a pre-foamed panel, preferably made in a continuous double belt foaming process.

10. The cold appliance according to claim 1, wherein the bottom plate (31) comprises a support means, such as feet and/or wheels, and preferably also leveling means.

11. The cold appliance according to claim 1, wherein a condensation preventing device (160) comprising a heat carrier tube (28, 160) is arranged in thermal contact with the condenser tube (32).

12. The cold appliance according to claim 1, wherein the bottom plate (31) comprises fastening means to securely fasten the compressor, and fastening means to securely fasten a fan and part of a door hinge.

13. A cold appliance comprising a cooling module (102), and a cabinet (101), which comprises a cold compartment (104), wherein the cooling module comprises an air outlet (43) delivering cooled air to the cold compartment, and an air inlet (44) receiving air from the cold compartment, wherein the cooling module is arranged at the bottom of the cold appliance, and wherein the cooling module comprises a cold section (34), a warm section (35), which is separated from the cold section by an insulating wall (105), an evaporator (33) arranged in the cold section, and a compressor (36) and a condenser (32) arranged in the warm section, characterized in that the condenser comprises a condenser tube (32) including condenser tube windings integrated into a bottom plate (31) of the cooling module that extend horizontally, wherein the direct contact or integration between the windings and the bottom plate facilitates heat transfer between the windings and the bottom plate, wherein the cooling module further comprises an inlet opening (38), an outlet opening (41), a partition wall (40), and a fan (37) configured to draw air through the inlet opening (38) and over the bottom plate (31) and expel the air out of the outlet opening (41), wherein the partition wall (40) is arranged such that air passing from the inlet opening (38) to the outlet opening (41) travels from the inlet opening (38) in a first direction, around the partition wall (40), and then toward the outlet opening (41) in a second direction that is opposite the first direction, and wherein the cooling module further comprises at least one curved fin arranged to guide air passing from the inlet opening (38) to the outlet opening (41) around the partition wall (40).

14. The cold appliance according to claim 13, wherein the cooling module (102) comprises a drain water tray (46) for receiving defrost water from the evaporator (33), wherein the drain water tray is in direct contact with the condenser tube (32).

15. The appliance according to claim 14, wherein the drain water tray (46) is constituted by a portion of the bottom plate (31).

16. A cold appliance comprising a cooling module (102), and a cabinet (101), which comprises a cold compartment (104), wherein the cooling module comprises an air outlet (43) delivering cooled air to the cold compartment, and an air inlet (44) receiving air from the cold compartment, wherein the cooling module is arranged at the bottom of the cold appliance, and wherein the cooling module comprises a cold section (34), a warm section (35), which is separated from the cold section by an insulating wall (105), an evaporator (33) arranged in the cold section, and a compressor (36) and a condenser (32) including condenser tube windings on or integrated into a bottom plate (31) of the cooling module, wherein a drain water tray (46) is configured to receive defrost water from the evaporator, wherein the condenser tube windings extend horizontally across a majority area of a horizontal cross-section of the cooling module (102), wherein the cooling module further comprises an inlet opening (38), an outlet opening (41), a partition wall (40), and a fan (37) configured to draw air through the inlet opening (38) and over the bottom plate (31) and expel the air out of the outlet opening (41), wherein the partition wall (40) is arranged such that air passing from the inlet opening (38) to the outlet opening (41) travels from the inlet opening (38) in a first direction, around the partition wall (40), and then toward the outlet opening (41) in a second direction that is opposite the first direction, and wherein the cooling module further comprises at least one curved fin arranged to guide air passing from the inlet opening (38) to the outlet opening (41) around the partition wall (40).

17. The cold appliance according to claim 1, further comprising a pre-defroster plate (47) arranged above the evaporator (33) and in contact with the evaporator (33), configured for directing airflow from the air inlet (44) to the evaporator (33) and directing the airflow over and in contact with the pre-defroster plate (47).

18. The cold appliance according to claim 17, wherein the pre-defroster plate (47) is inclined such that water that collects on the plate will flow down onto a defrost water collecting device (48) arranged below the evaporator (33).

19. The cold appliance according to claim 16, wherein the inlet opening (38) and outlet opening (41) are arranged side by side.

20. The cold appliance according to claim 16, further comprising a plurality of curved fins arranged to guide air passing from the inlet opening (38) to the outlet opening (41) around the partition wall (40).

21. The cold appliance according to claim 16, wherein the at least one curved fin is arranged to guide air passing from the inlet opening (38) to the outlet opening (41) in a direction toward the outlet opening (41).

22. The cold appliance according to claim 20, wherein air enters the plurality of curved fins in a direction transverse to the first and second directions and air exits the plurality of curved fins in the second direction.

23. The cold appliance according to claim 20, wherein air enters the plurality of curved fins in a direction perpendicular to the first and second directions and air exits the plurality of curved fins in the second direction.

24. The cold appliance according to claim 20, wherein the plurality of curved fins extend substantially parallel to each other.

25. The cold appliance according to claim 16, wherein the cooling module comprises and front wall and a rear wall and the partition wall extends rearward from the front wall a distance but does not extend completely to the rear wall.

* * * * *